US006951171B2

(12) United States Patent
Oohashi et al.

(10) Patent No.: US 6,951,171 B2
(45) Date of Patent: Oct. 4, 2005

(54) PLANOGRAPHIC PRINTING PLATE PRECURSOR

(75) Inventors: Hidekazu Oohashi, Shizuoka-ken (JP); Koichi Kawamura, Shizuoka-ken (JP); Miki Takahashi, Shizuoka-ken (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 10/208,858

(22) Filed: Aug. 1, 2002

(65) Prior Publication Data

US 2003/0129520 A1 Jul. 10, 2003

(30) Foreign Application Priority Data

Aug. 1, 2001 (JP) ..... 2001-233566

(51) Int. Cl.[7] ..... B41N 1/08
(52) U.S. Cl. ..... 101/457; 101/459; 430/302
(58) Field of Search ..... 101/454, 456, 101/457, 458, 459, 462, 467; 430/270.1, 271.1, 302, 348

(56) References Cited

U.S. PATENT DOCUMENTS 4,004,924 A * 1/1977 Vrancken et al. ..... 430/325
4,948,694 A * 8/1990 Ohkuma et al. ..... 430/138
5,807,659 A * 9/1998 Nishimiya et al. ..... 430/302
6,114,089 A * 9/2000 Takita et al. ..... 430/278.1
6,354,209 B1 * 3/2002 Van Aert et al. ..... 101/466
6,566,029 B2 * 5/2003 Kawamura et al. ..... 430/138
6,593,059 B2 * 7/2003 Kawamura et al. ..... 430/270.1
6,599,674 B1 * 7/2003 Kawamura ..... 430/270.1
6,607,866 B1 * 8/2003 Kawamura et al. ..... 430/270.1

FOREIGN PATENT DOCUMENTS

EP 1088679 * 4/2001

* cited by examiner

*Primary Examiner*—Stephen R. Funk
(74) *Attorney, Agent, or Firm*—Burns, Doane, Swecker & Mathis LLP

(57) ABSTRACT

The present invention relates to a planographic printing plate precursor comprising a substrate comprising a hydrophilic surface having disposed thereon a heat-sensitive layer containing a thermoplastic particulate polymer having functional groups capable of interacting with the hydrophilic surface. Preferably, hydrophilic graft polymer chains are present on the hydrophilic surface of the substrate. The present invention further relates to a planographic printing plate precursor comprising a substrate comprising a hydrophilic surface having disposed thereon a heat-sensitive layer comprising microcapsules comprising a compound having functional groups capable of interacting with the hydrophilic surface. In addition, the present invention relates to methods of printing with the planographic printing plate precursors.

10 Claims, No Drawings

PLANOGRAPHIC PRINTING PLATE PRECURSOR

BACKGROUND OF THE INVENTION

1. Field of the Invention

The present invention relates to a negative planographic printing plate precursor. The invention relates in particular to a planographic printing plate precursor that can be used in plate-making by scan-exposure based on digital signals, can provide contaminant-free prints, having high sensitivity and high printing resistance, and can be disposed in a printer directly without particular development after image formation.

2. Description of the Related Art

Numerous studies have been made on printing plates for the computer-to-plate system, where development has been significant in recent years. In these studies, in order to further simplify the printing process and solve the problem of waste solution disposal, a development-free planographic printing plate precursor that can be used in printing without development after light exposure by directly disposing it in a printer has been studied, and various methods have been proposed.

To eliminate any treatment steps of the printing process, there is a method called development in a machine, wherein an exposed planographic printing plate precursor is disposed on a cylinder in a printer, and the non-image part of the planographic printing plate precursor is removed by rotating the cylinder and supplying moistening water and ink thereto. That is, the planographic printing plate precursor is exposed to light and directly disposed in a printer, whereby processing can be concluded in the process of ordinary printing.

It is necessary that the planographic printing plate precursor suitable for development in a machine has a photosensitive layer soluble in moistening water and an ink solvent, and can be handled in a bright room so as to be suitable for development in a printer placed in a bright room.

For example, Japanese Patent No. 2938397 discloses a planographic printing plate precursor comprising a hydrophilic substrate having disposed thereon a heat-sensitive layer having fine thermoplastic hydrophobic polymer particles dispersed in a hydrophilic binder polymer. In this patent, it is disclosed that the planographic printing plate precursor can be developed in a machine by thermally fusing the fine thermoplastic hydrophobic polymer particles upon exposure to an infrared laser to form an image on the plate, then disposing the plate on a cylinder in a printer, and developing the plate in the printer with moistening water and/or ink.

In such a method of forming an image by mere heat fusion, the non-image region on the recording layer has good development performance in the machine, but the strength of the image region is weak and printing resistance is insufficient. Further, when the heat-sensitive layer is disposed directly on an aluminum substrate generally used as the substrate for a planographic printing plate precursor, heat generated by light exposure is removed by the highly heat-conductive aluminum substrate so that, in the vicinity of an interface between the substrate and the heat-sensitive layer, the heat energy cannot be sufficiently used in image formation, i.e., in heat fusion of the fine particles, whereby the image region cannot be sufficiently hardened and printing resistance is insufficient.

SUMMARY OF THE INVENTION

In consideration of the disadvantages in the prior art described above, an object of the present invention is to provide a planographic printing plate precursor that has excellent development performance in a machine, high sensitivity and high printing resistance.

To solve the problem described above, the present inventors conducted extensive research and found that by introducing functional groups capable of interacting with a hydrophilic surface, with graft polymers being preferably present on the surface of the substrate, into a thermoplastic compound that is thermally fused to form an image region, adhesion can be improved and sufficient printing resistance can be achieved without impairing development performance in the machine. The invention was thereby completed.

The present invention provides a planographic printing plate precursor of the invention which comprises a substrate comprising a hydrophilic surface having disposed thereon a heat-sensitive layer comprising at least one selected from the group consisting of (a) a thermoplastic particulate polymer having functional groups capable of interacting with the hydrophilic surface and (b) microcapsules containing a compound having functional groups capable of interacting with the hydrophilic surface.

As a specific embodiment, the present invention provides the planographic printing plate precursor comprising a substrate comprising a hydrophilic surface having disposed thereon a heat-sensitive layer containing a thermoplastic particulate polymer having functional groups capable of interacting with the hydrophilic surface.

In another embodiment, the present invention further provides the planographic printing plate precursor, wherein the heat fusion temperature of the thermoplastic particulate polymer is 80 to 250° C.

In another embodiment, the present invention further provides the planographic printing plate precursor, wherein the average particle diameter of the thermoplastic particulate polymer is 0.01 to 20 $\mu$m.

In another embodiment, the present invention further provides the planographic printing plate precursor, wherein the heat-sensitive layer further comprises a hydrophilic resin and a light-heat converting agent.

In another embodiment, the present invention further provides the planographic printing plate precursor, wherein hydrophilic graft polymer chains are present on the hydrophilic surface of the substrate.

In another embodiment, the present invention further provides the planographic printing plate precursor, wherein the hydrophilic surface on which hydrophilic graft polymer chains are present has been roughened.

In another embodiment, the present invention further provides the planographic printing plate precursor, wherein the substrate is an aluminum substrate.

In another embodiment, the present invention further provides the planographic printing plate precursor, wherein the surface of the aluminum substrate has been rendered hydrophilic.

The present invention also provides a planographic printing plate precursor comprising a substrate comprising a hydrophilic surface having disposed thereon a heat-sensitive layer containing microcapsules containing a compound having functional groups capable of interacting with the hydrophilic surface.

In another embodiment, the present invention further provides the planographic printing plate precursor, wherein the average particle diameter of the microcapsules is 0.01 to 20 $\mu$m.

In another embodiment, the present invention further provides the planographic printing plate precursor, wherein the heat-sensitive layer further comprises a hydrophilic resin and a light-heat converting agent.

In another embodiment, the present invention further provides the planographic printing plate precursor, wherein hydrophilic graft polymer chains are present on the hydrophilic surface of the substrate.

In another embodiment, the present invention further provides the planographic printing plate precursor, wherein the hydrophilic surface on which hydrophilic graft polymer chains are present has been roughened.

In another embodiment, the present invention further provides the planographic printing plate precursor, wherein the substrate is an aluminum substrate.

In another embodiment, the present invention further provides the planographic printing plate precursor, wherein the surface of the aluminum substrate has been rendered hydrophilic.

The present invention also provides a method of printing with a planographic printing plate precursor having an image thermally formed thereon and comprising a substrate comprising a hydrophilic surface having disposed thereon a heat-sensitive layer containing a thermoplastic particulate polymer having functional groups capable of interacting with the hydrophilic surface.

The present invention further provides a method of printing with a planographic printing plate precursor having an image thermally formed thereon and comprising a substrate comprising a hydrophilic surface having disposed thereon a heat-sensitive layer containing microcapsules containing a compound having functional groups capable of interacting with the hydrophilic surface.

The substrate having a hydrophilic surface is preferably a substrate having a hydrophilic surface on which hydrophilic graft polymer chains are present to express high hydrophilicity, but may be an aluminum substrate rendered hydrophilic in a usual manner by treatment with silicate and so on.

In the present invention, an image is formed by heat resulting from light-heat conversion due to exposure to a heat laser or by heat from a thermal head. In the non-heated region, no change occurs, so the particulate polymer having functional groups interacting with the surface of the substrate is maintained in the form of fine particles, and the heat-sensitive layer containing the fine polymer particles can be easily removed from the substrate by water and/or ink, whereby the hydrophilic surface of the substrate is exposed to act as a moistening water-receiving region (non-image region). On the other hand, in the heated region, the fine polymer particles having functional groups interacting with the surface of the substrate are fused with one another to form a hydrophobic coating serving as an ink-receiving region. The resulting coating adheres tightly to the substrate via the substrate-interacting functional groups of the particulate polymers or microcapsules. Accordingly, the image region is not removed in the printer and has very high printing resistance.

For these reasons, the planographic printing plate precursor of the invention is usable in printing directly from digital data in computers or the like by recording with a solid laser or semiconductor laser emitting infrared rays, has excellent printing resistance, and is free of contaminants.

It is thought that by providing the substrate thereon with a hydrophilic surface on which hydrophilic graft polymer chains are present according to a preferable aspect of the invention, the surface has very high hydrophilicity, while the polymer layer shows an excellent heat-insulating effect by which the heat generated in the heat-sensitive layer does not diffuse into the aluminum substrate and can thus be utilized efficiently in image formation to achieve higher sensitivity. The non-image region on the surface of the substrate is highly hydrophilic so that non-fused fine particles or microcapsules participating in image formation and not interacting with hydrophilic graft polymer chains can be easily diffused and removed with a very small amount of water or hydrophilic components, thus achieving excellent development performance in the machine.

DESCRIPTION OF THE PREFERRED EMBODIMENTS

Hereinafter, the present invention is described in detail.

The planographic printing plate precursor of the present invention comprises a substrate comprising a hydrophilic surface having disposed thereon a heat-sensitive layer containing a thermoplastic particulate polymer in a particulate or microcapsule form and having functional groups capable of interacting with the hydrophilic surface.

Heat-sensitive Layer

The heat-sensitive layer of the present invention can contain at least one component selected from (a) a thermoplastic particulate polymer having, in the molecule thereof, functional groups capable of interacting with the hydrophilic surface (also referred to as particulate polymer) and (b) microcapsules containing a compound having, in the molecule thereof, functional groups capable of interacting with the hydrophilic surface (also referred to as microcapsules). First, the functional groups interacting with the hydrophilic surface are described.

(a) thermoplastic particulate polymer having, in the molecule thereof, functional groups capable of interacting with the hydrophilic surface The functional groups which on the particulate polymer used in the invention, interact with the hydrophilic surface of the substrate include those interacting with the hydrophilic surface of the substrate via covalent bonding, ionic bonding, hydrogen bonding, polar interaction or van del Waals interaction.

From the viewpoint of higher sensitivity in the invention, ionic bonding and hydrogen bonding acting as strong bonding (interaction) without particular application of energy (e.g. heat) are particularly preferable as interaction.

Such functional groups are varied depending on the substrate having the hydrophilic surface, but for aluminum substrates used often in planographic printing plate precursors, the following functional groups can be used.

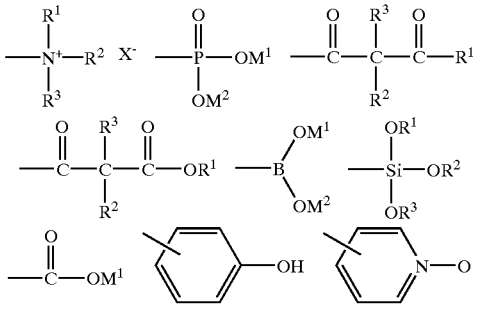

-continued

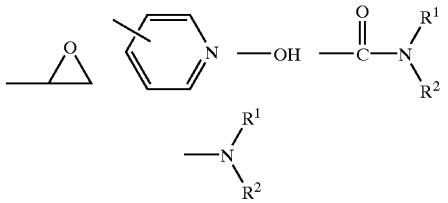

(wherein $R^1$ to $R^3$ represent a hydrogen atom, an alkyl group, aryl group, alkynyl group and alkenyl group, $M^1$ and $M^2$ represent a hydrogen atom and metal atom, and $X^-$ represents a counter anion.)

Introduction of these functional groups into the particulate polymer may be conducted during polymerization or by polymer reaction after polymerization.

For introduction during polymerization, monomers having these functional groups are subjected preferably to emulsion polymerization or suspension polymerization. Further, as described above, the polymeric compounds having such functional groups are dissolved in an organic solvent and then emulsified and dispersed in water with an emulsifier or a dispersant, and the organic solvent may be evaporated.

As specific example, the monomers used for synthesis of the particulate polymer consisting of polymeric compounds having functional groups interacting with the surface of the substrate in the invention, that is, the monomers having the above functional groups or the monomers from which such functional groups can be derived include, but are not limited to, the following monomers:

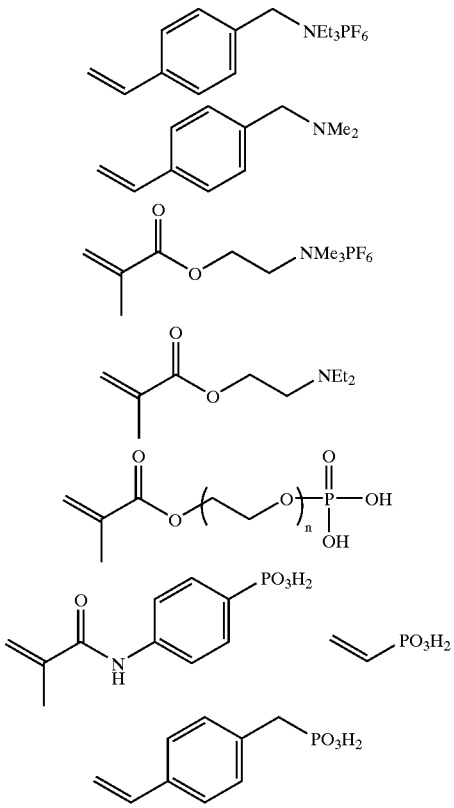

-continued

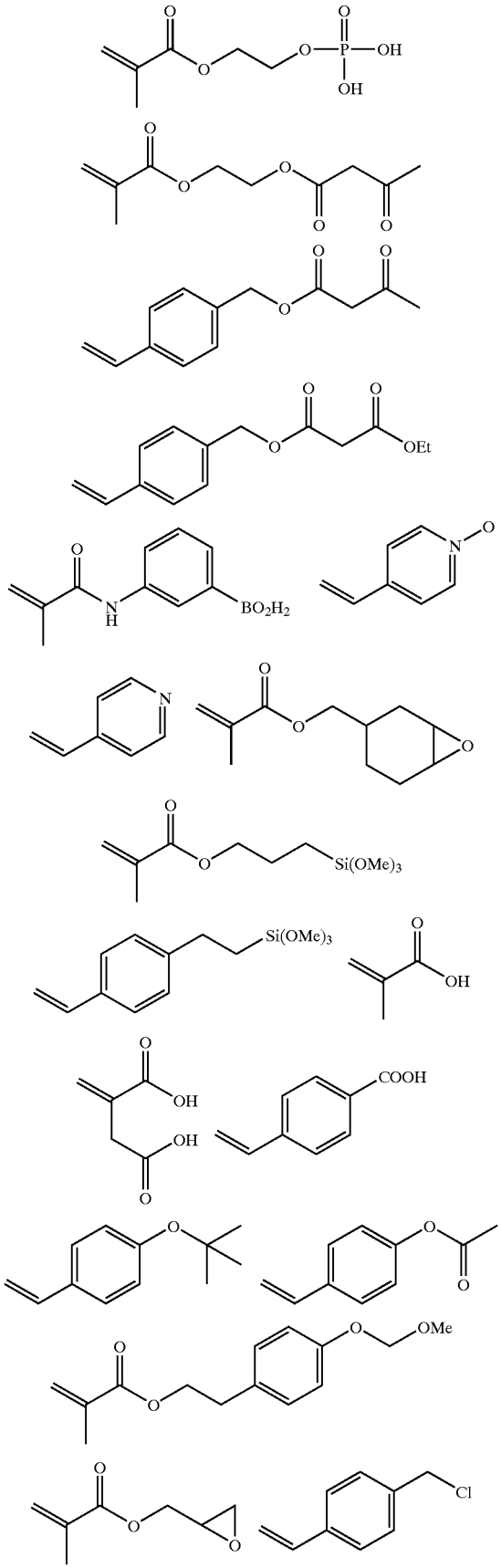

-continued

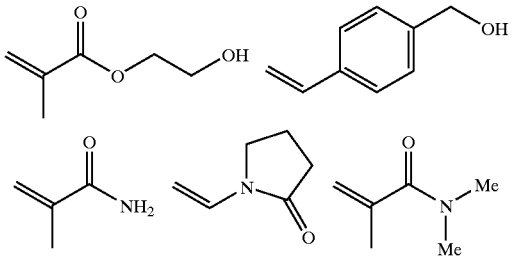

The resin having functional groups interacting with the surface of the substrate used in the invention can be obtained by polymerizing one kind of monomer or copolymerizing two or more kinds of monomers. Further, the resin having the functional groups used in the invention is not particularly limited and may have functional groups other than those described above insofar as the resin has the functional groups described above. Accordingly, even if the resin is a copolymer with monomers having functional groups other than said functional groups, the resin can be used preferably unless the effect of the invention is hindered. Such radical polymerizable monomers include the following monomers:

The radical polymerizable monomers usable in the invention include known monomers such as acrylic acid, acrylate esters, acryl amides, methacrylic acid, methacrylate esters, methacryl amides, maleic acid, maleic anhydride, maleates, maleic acid amides, maleic acid imides, itaconic acid, itaconic anhydride, itaconate esters, itaconic acid amides, itaconic acid imides, crotonic acid, crotonates, crotonic acid amides, fumaric acid, fumarate esters, fumaric acid amides, mesaconic acid, mesaconates, mesaconic acid amides, α,β-unsaturated lactones, α, β-unsaturated lactams, unsaturated hydrocarbons, vinyl ethers, vinyl esters, α,β-unsaturated ketones, and styrene and analogues thereof.

Examples of the acrylate esters include methyl acrylate, ethyl acrylate, (n- or i-) propyl acrylate, (n-, i-, sec- or t-) butyl acrylate, pentyl acrylate, hexyl acrylate, heptyl acrylate, octyl acrylate, nonyl acrylate, decyl acrylate, amyl acrylate, 2-ethyl hexyl acrylate, dodecyl acrylate, chloroethyl acrylate, 2-hydroxyethyl acrylate, 2-hydroxypropyl acrylate, 5-hydroxypentyl acrylate, cyclohexyl acrylate, allyl acrylate, trimethylol propane monoacrylate, pentaerythritol monoacrylate, benzyl acrylate, methoxybenzyl acrylate, chlorobenzyl acrylate, hydroxybenzyl acrylate, hydroxy phenetyl acrylate, dihydroxy phenetyl acrylate, furfuryl acrylate, tetrahydrofurfuryl acrylate, phenyl acrylate, hydroxyphenyl acrylate, chlorophenyl acrylate, sulfamonyl phenyl acrylate and 2-(hydrophenylcarbonyloxy)ethyl acrylate.

Examples of the acrylamides include acrylamide, N-methyl acrylamide, N-ethyl acrylamide, N-(n- or i-) propyl acrylamide, N-(n-, i-, sec- or t-) acrylamide, N-benzyl acrylamide, N-hydroxyethyl acrylamide, N-phenyl acrylamide, N-tolyl acrylamide, N-(hydroxyphenyl) acrylamide, N-(sulfamoyl phenyl) acrylamide, N-(phenyl sulfonyl) acrylamide, N-(tolyl sulfonyl) acrylamide, N,N-dimethyl acrylamide, N-methyl-N-phenyl acrylamide and N-hydroxyethyl-N-methyl acrylamide.

Examples of the methacrylate esters include methyl methacrylate, ethyl methacrylate, (n- or i-) propyl methacrylate, (n-, i-, sec- or t-) butyl methacrylate, pentyl methacrylate, hexyl methacrylate, heptyl methacrylate, octyl methacrylate, nonyl methacrylate, decyl methacrylate, amyl methacrylate, 2-ethyl hexyl methacrylate, dodecyl methacrylate, chloroethyl methacrylate, 2-hydroxy ethyl methacrylate, 2-hydroxy propyl methacrylate, 5-hydroxy pentyl methacrylate, cyclohexyl methacrylate, allyl methacrylate, trimethylol propane monomethacrylate, pentaerythritol monomethacrylate, benzyl methacrylate, methoxy benzyl methacrylate, chlorobenzyl methacrylate, hydroxy benzyl methacrylate, hydroxy phenetyl methacrylate, dihydroxyphenetyl methacrylate, furfuryl methacrylate, tetrahydrofurfuryl methacrylate, phenyl methacrylate, hydroxyphenyl methacrylate, chlorophenyl methacrylate, sulfamoyl phenyl methacrylate and 2-(hydroxyphenyl carbonyloxy) ethyl methacrylate.

Examples of the methacrylamides include methacrylamide, N-methyl methacrylamide, N-ethyl methacrylamide, N-(n- or i-) propyl methacrylamide, N-(n-, i-, sec- or t-) methacrylamide, N-benzyl methacrylamide, N-hydroxyethyl methacrylamide, N-phenyl methacrylamide, N-tolyl methacrylamide, N-(hydroxyphenyl) methacrylamide, N-(sulfamoyl phenyl) methacrylamide, N-(phenyl sulfonyl) methacrylamide, N-(tolyl sulfonyl) methacrylamide, N,N-dimethyl methacrylamide, N-methyl-N-phenyl methacrylamide and N-hydroxyethyl-N-methyl methacrylamide.

Examples of the crotonate esters include methyl crotonate, ethyl crotonate, (n- or i-) propyl crotonate, (n-, i-, sec- or t-) butyl crotonate, pentyl crotonate, hexyl crotonate, heptyl crotonate, octyl crotonate, nonyl crotonate, decyl crotonate, amyl crotonate, 2-ethyl hexyl crotonate, dodecyl crotonate, chloroethyl crotonate, 2-hydroxy ethyl crotonate, 2-hydroxy propyl crotonate, 5-hydroxy pentyl crotonate, cyclohexyl crotonate, allyl crotonate, trimethylol propane monocrotonate, pentaerythritol monocrotonate, benzyl crotonate, methoxy benzyl crotonate, chlorobenzyl crotonate, hydroxy benzyl crotonate, hydroxy phenetyl crotonate, dihydroxyphenetyl crotonate, furfuryl crotonate, tetrahydrofurfuryl crotonate, phenyl crotonate, hydroxyphenyl crotonate, chlorophenyl crotonate, sulfamoyl phenyl crotonate and 2-(hydroxyphenyl carbonyloxy) ethyl crotonate.

Examples of the crotonic acid amides include crotonic acid amide, N-methyl crotonic acid amide, N-ethyl crotonic acid amide, N-(n- or i-) propyl crotonic acid amide, N-(n-, i-, sec- or t-) crotonic acid amide, N-benzyl crotonic acid amide, N-hydroxyethyl crotonic acid amide, N-phenyl crotonic acid amide, N-tolyl crotonic acid amide, N-(hydroxyphenyl) crotonic acid amide, N-(sulfamoyl phenyl) crotonic acid amide, N-(phenyl sulfonyl) crotonic acid amide, N-(tolyl sulfonyl) crotonic acid amide, N,N-dimethyl crotonic acid amide, N-methyl-N-phenyl crotonic acid amide and N-hydroxyethyl-N-methyl crotonic acid amide.

Examples of the maleate esters include dimethyl maleate, diethyl maleate, di(n- or i-) propyl maleate, di(n-, i-, sec- or t-) butyl maleate, diphenyl maleate, diallyl maleate, monomethyl maleate, monoethyl maleate, mono(n- or i-) propyl maleate, mono(n-, i-, sec- or t-) butyl maleate, dibenzyl maleate, monobenzyl maleate, methyl ethyl maleate, methyl propyl maleate and ethyl propyl maleate.

Examples of the maleic acid amides include maleic acid amide, N-methyl maleic acid amide, N-ethyl maleic acid amide, N-(n- or i-) propyl maleic acid amide, N-(n-, i-, sec- or t-) butyl maleic acid amide, N-benzyl maleic acid amide, N-hydroxyethyl maleic acid amide, N-phenyl maleic acid amide, N-tolyl maleic acid amide, N-(hydroxyphenyl) maleic acid amide, N-(sulfamoyl phenyl) maleic acid amide, N-(phenyl sulfonyl) maleic acid amide, N-(tolyl sulfonyl) maleic acid amide, N,N-dimethyl maleic acid amide, N-methyl-N-phenyl maleic acid amide, N-hydroxyethyl-N-methyl maleic acid amide, N-methyl maleic acid monoamide, N-ethyl maleic acid monoamide, N,N-dimethyl maleic acid monoamide, N-methyl-N'-ethyl maleic acid amide and N-methyl-N'-phenyl maleic acid amide.

Examples of the maleic acid imides include maleic acid imide, N-methylmaleicacidiimide, N-ethylmaleicacidimide, N-(n- or i-) propyl maleic acid imide, N-(n-, i-, sec- or t-) butyl maleic acid imide, N-benzyl maleic acid imide, N-hydroxyethyl maleic acid imide, N-phenyl maleic acid imide, N-tolyl maleic acid imide, N-(hydroxyphenyl) maleic acid imide, N-(sulfamoyl phenyl) maleic acid imide, N-(phenyl sulfonyl) maleic acid imide and N-(tolyl sulfonyl) maleic acid imide.

Examples of the itaconate esters include dimethyl itaconate, diethyl itaconate, di(n- or i-) propyl itaconate, di(n-, i-, sec- or t-) butyl itaconate, diphenyl itaconate, diallyl itaconate, monomethyl itaconate, monoethyl itaconate, mono(n- or i-) propyl itaconate, mono(n-, i-, sec- or t-) butyl itaconate, dibenzyl itaconate, monobenzyl itaconate, methyl ethyl itaconate, methyl propyl itaconate and ethyl propyl itaconate.

Examples of the itaconic acid amides include itaconic acid amide, N-methyl itaconic acid amide, N-ethyl itaconic acid amide, N-(n- or i-) propyl itaconic acid amide, N-(n-, i-, sec- or t-) butyl itaconic acid amide, N-benzyl itaconic acid amide, N-hydroxyethyl itaconic acid amide, N-phenyl itaconic acid amide, N-tolyl itaconic acid amide, N-(hydroxyphenyl) itaconic acid amide, N-(sulfamoyl phenyl) itaconic acid amide, N-(phenyl sulfonyl) itaconic acid amide, N-(tolyl sulfonyl) itaconic acid amide, N,N-dimethyl itaconic acid amide, N-methyl-N-phenyl itaconic acid amide, N-hydroxyethyl-N-methyl itaconic acid amide, N-methyl itaconic acid monoamide, N-ethyl itaconic acid monoamide, N,N-dimethyl itaconic acid monoamide, N-methyl-N'-ethyl itaconic acid amide and N-methyl-N'-phenyl itaconic acid amide.

Examples of the itaconic acid imides include itaconic acid imide, N-methyl itaconic acid imide, N-ethyl itaconic acid imide, N-(n- or i-) propyl itaconic acid imide, N-(n-, i-, sec- or t-) butyl itaconic acid imide, N-benzyl itaconic acid imide, N-hydroxyethyl itaconic acid imide, N-phenyl itaconic acid imide, N-tolyl itaconic acid imide, N-(hydroxyphenyl) itaconic acid imide, N-(sulfamoyl phenyl) itaconic acid imide, N-(phenyl sulfonyl) itaconic acid imide and N-(tolyl sulfonyl) itaconic acid imide.

Examples of the fumarate esters include dimethyl fumarate, diethyl fumarate, di(n- or i-) propyl fumarate, di(n-, i-, sec- or t-) butyl fumarate, diphenyl fumarate, diallyl fumarate, monomethyl fumarate, monoethyl fumarate, mono(n- or i-) propyl fumarate, mono(n-, i-, sec- or t-) butyl fumarate, dibenzyl fumarate, monobenzyl fumarate, methyl ethyl fumarate, methyl propyl fumarate and ethyl propyl fumarate.

Examples of the fumaric acid amides include fumaric acid amide, N-methyl fumaric acid amide, N-ethyl fumaric acid amide, N-(n- or i-) propyl fumaric acid amide, N-(n-, i-, sec- or t-) butyl fumaric acid amide, N-benzyl fumaric acid amide, N-hydroxyethyl fumaric acid amide, N-phenyl fumaric acid amide, N-tolyl fumaric acid amide, N-(hydroxyphenyl) fumaric acid amide, N-(sulfamoyl phenyl) fumaric acid amide, N-(phenyl sulfonyl) fumaric acid amide, N-(tolyl sulfonyl) fumaric acid amide, N,N-dimethyl fumaric acid amide, N-methyl-N-phenyl fumaric acid amide, N-hydroxyethyl-N-methyl fumaric acid amide, N-methyl fumaric acid monoamide, N-ethyl fumaric acid monoamide, N,N-dimethyl fumaric acid monoamide, N-methyl-N'-ethyl fumaric acid amide and N-methyl-N'-phenyl fumaric acid amide.

Examples of the mesaconate esters include dimethyl mesaconate, diethyl mesaconate, di(n- or i-) propyl mesaconate, di(n-, i-, sec- or t-) butyl mesaconate, diphenyl mesaconate, diallyl mesaconate, monomethyl mesaconate, monoethyl mesaconate, mono(n- or i-) propyl mesaconate, mono(n-, i-, sec- or t-) butyl mesaconate, dibenzyl mesaconate, monobenzyl mesaconate, methyl ethyl mesaconate, methyl propyl mesaconate and ethyl propyl mesaconate.

Examples of the mesaconic acid amides include mesaconic acid amide, N-methyl mesaconic acid amide, N-ethyl mesaconic acid amide, N-(n- or i-) propyl mesaconic acid amide, N-(n-, i- , sec- or t-) butyl mesaconic acid amide, N-benzyl mesaconic acid amide, N-hydroxyethyl mesaconic acid amide, N-phenyl mesaconic acid amide, N-tolyl mesaconic acid amide, N-(hydroxyphenyl) mesaconic acid amide, N-(sulfamoyl phenyl) mesaconic acid amide, N-(phenyl sulfonyl) mesaconic acid amide, N-(tolyl sulfonyl) mesaconic acid amide, N,N-dimethyl mesaconic acid amide, N-methyl-N-phenyl mesaconic acid amide, N-hydroxyethyl-N-methyl mesaconic acid amide, N-methyl mesaconic acid monoamide, N-ethyl mesaconic acid monoamide, N,N-dimethyl mesaconic acid monoamide, N-methyl-N'-ethyl mesaconic acid amide and N-methyl-N'-phenyl mesaconic acid amide.

Examples of styrene and analogues thereof include styrene, methyl styrene, dimethyl styrene, trimethyl styrene, ethyl styrene, propyl styrene, cyclohexyl styrene, chloromethyl styrene, trifluoromethyl styrene, ethoxymethyl styrene, acetoxymethyl styrene, methoxy styrene, dimethoxy styrene, chlorostyrene, dichlorostyrene, bromostyrene, iodostyrene, fluorostyrene, carboxy styrene, and sodium 4-vinyl benzenesulfonate.

Example of the α,β-unsaturated lactones include the following compounds:

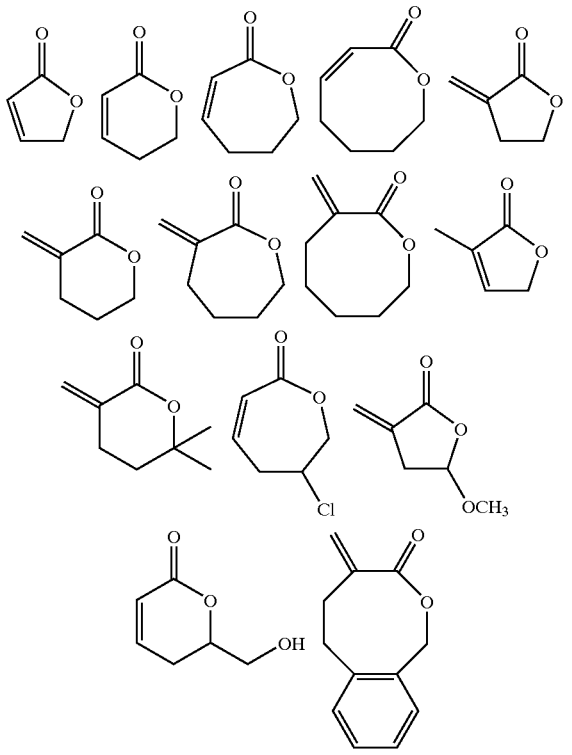

-continued
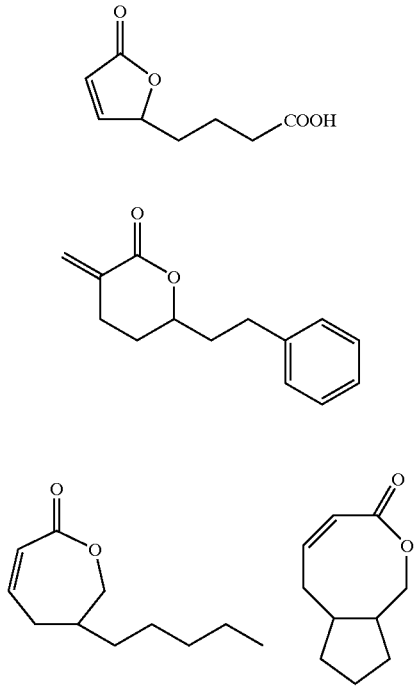
Example of the α,β-unsaturated lactams include the following compounds:
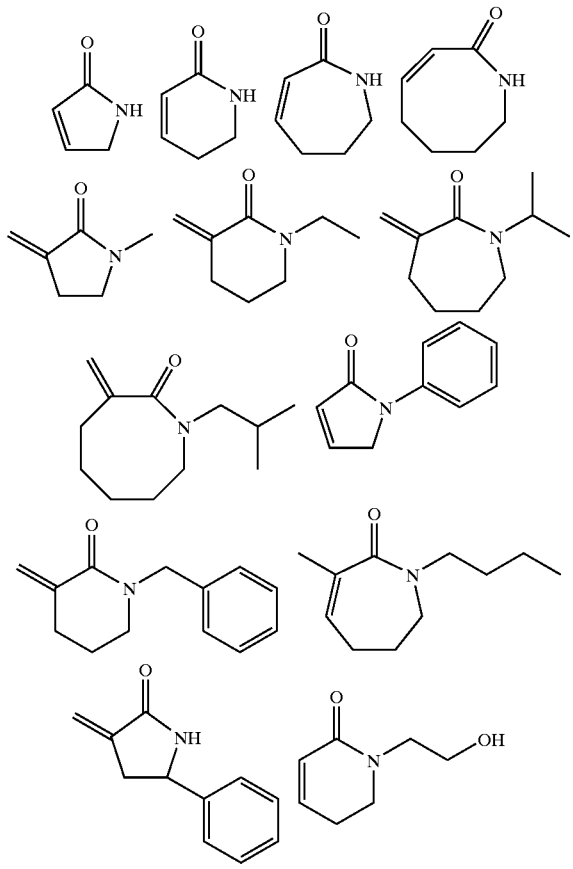
-continued
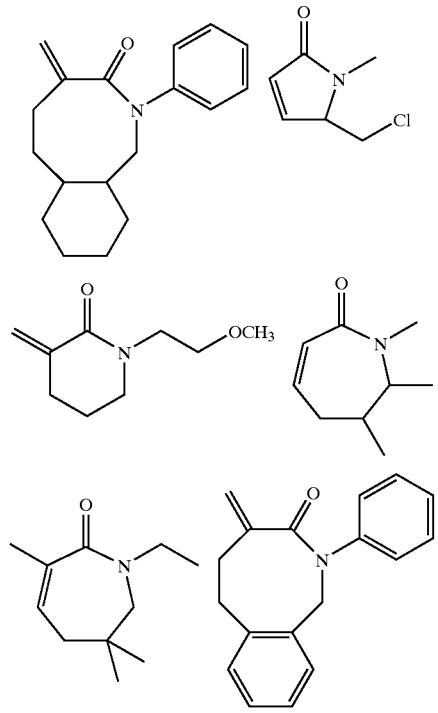
Example of the unsaturated hydrocarbons include the following compounds:
$CH_2{=}CH_2$ $CH_2{=}CHCH_3$ $CH{\equiv}CH$ $CH{\equiv}CCH_3$
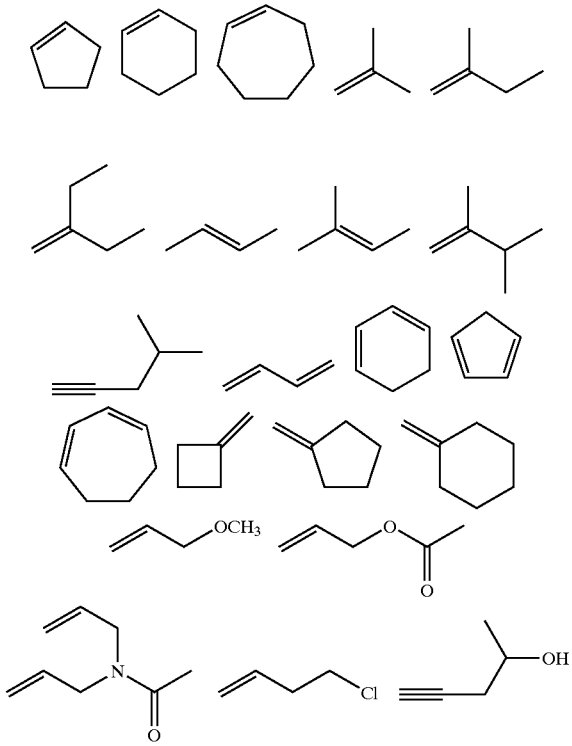

-continued

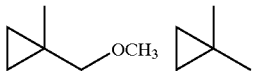

Example of the vinyl ethers include the following compounds:

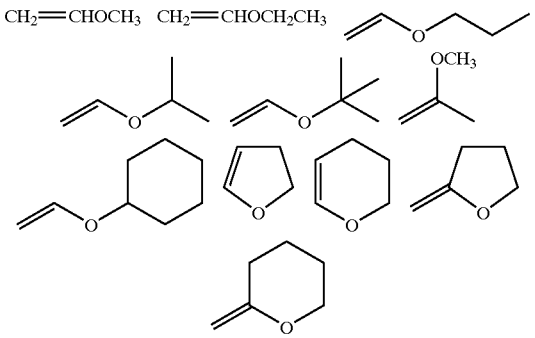

Example of the vinyl esters include the following compounds:

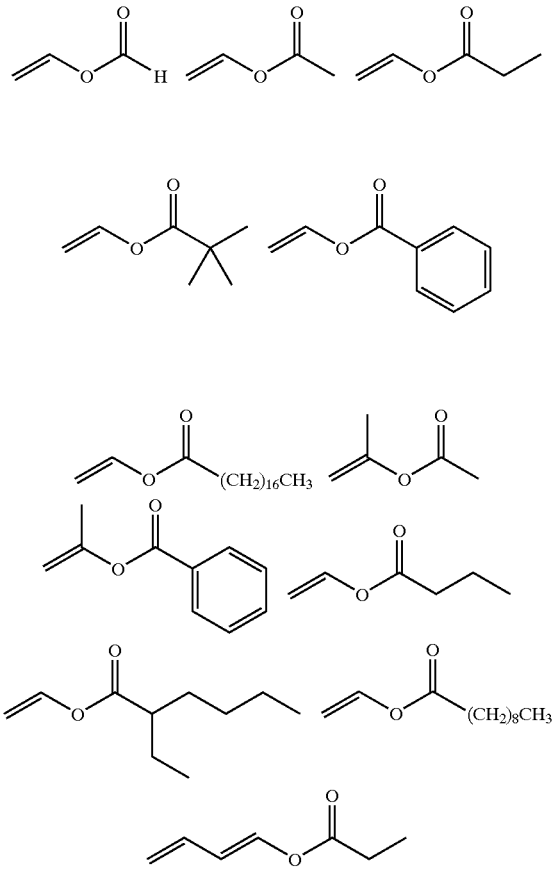

Example of the α,β-unsaturated ketones include the following compounds:

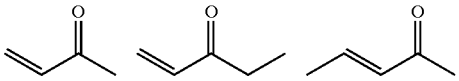

-continued

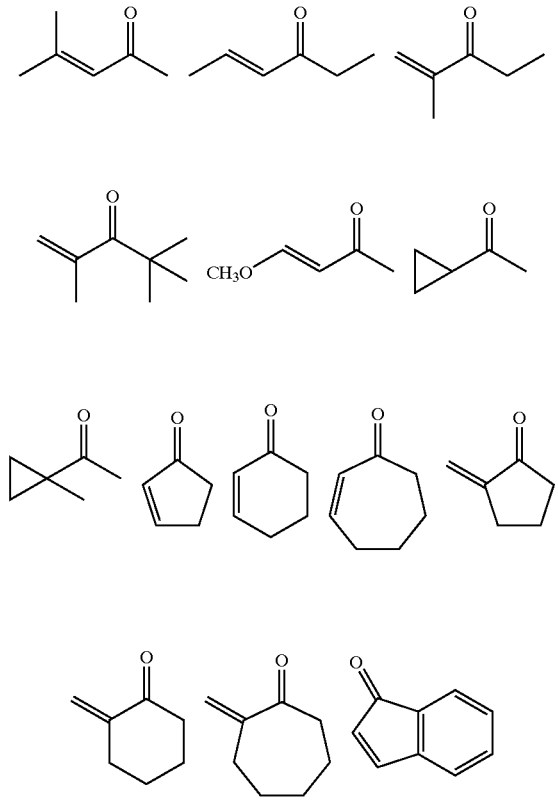

The ratio of the monomers having functional groups used for synthesis of the resin having functional groups interacting with the hydrophilic surface of the substrate used in the invention is preferably 1 mol-% or more, more preferably 5 mol-% or more. When the monomers having functional groups are used in an amount of 1 mol-% or more, the resin interacts sufficiently with the substrate to achieve high printing resistance. When other monomers not having the functional groups are used simultaneously in the copolymer, the other monomers can be used in any ratio insofar as the monomers having the functional groups are used in a preferably ratio. The copolymerizable other monomers may be used singly or in combination thereof.

Hereinafter, examples of the resin having functional groups interacting with the surface of the substrate used in the invention are shown. However, these examples are not intended to limit the invention.

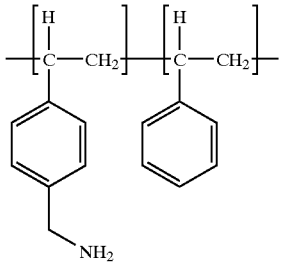

-continued
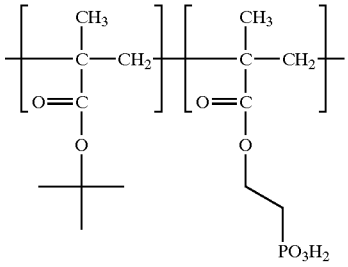
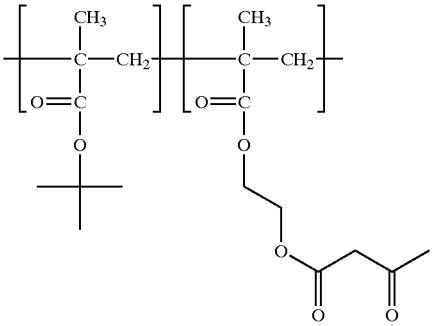
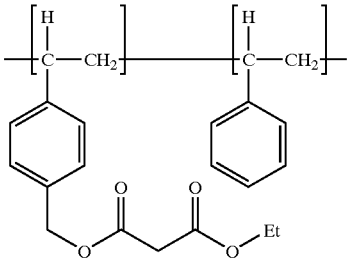
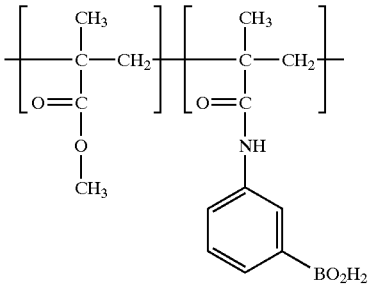
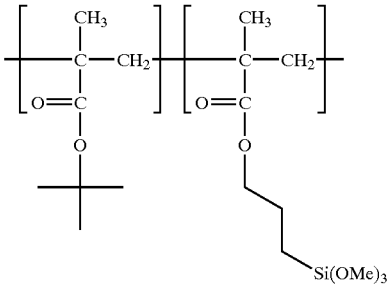
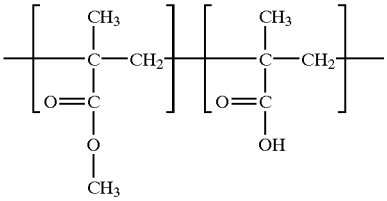
-continued
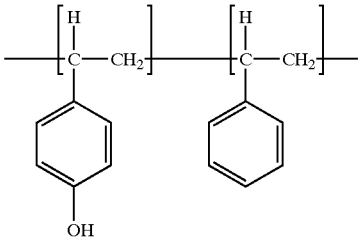
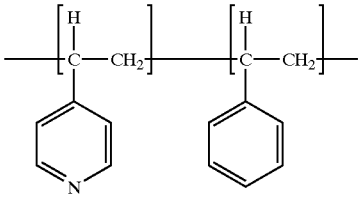
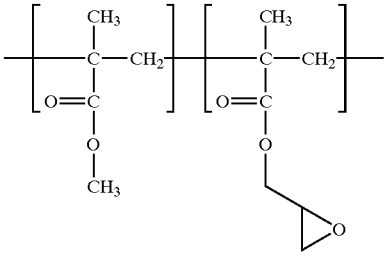
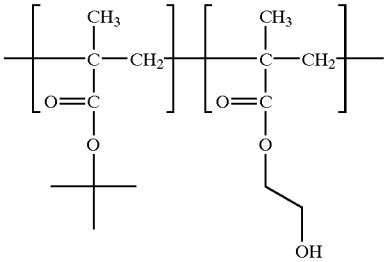
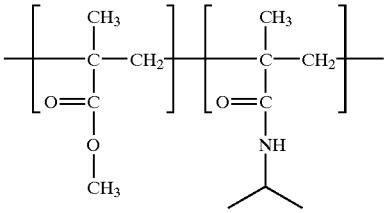
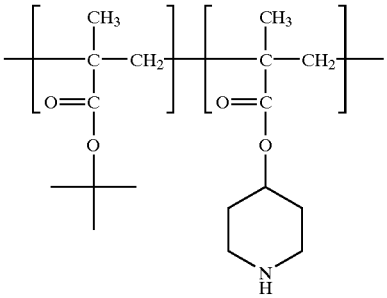

-continued

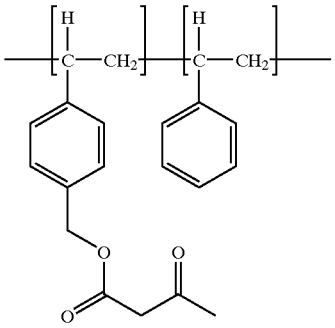

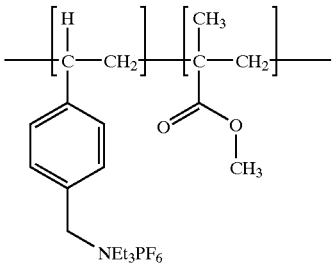

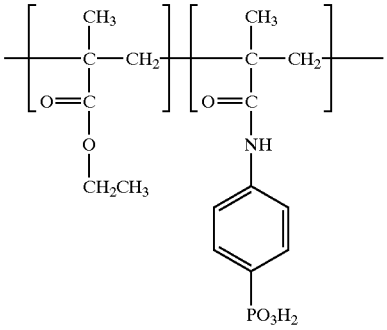

The particulate polymer used in the planographic printing plate precursor of the invention can also make use of particulate polymers synthesized by emulsion polymerization or suspension polymerization by using a surfactant having the functional groups as described above. Examples of the surfactant include the following surfactants. However, these examples are not intended to limit the invention.

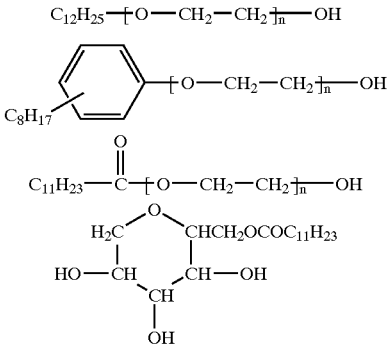

-continued

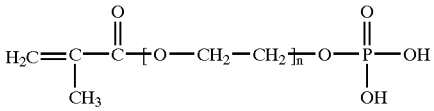

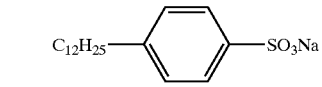

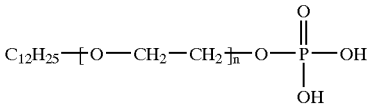

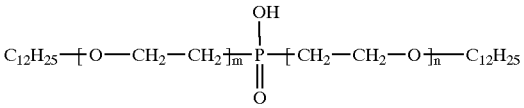

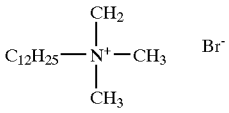

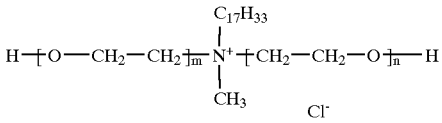

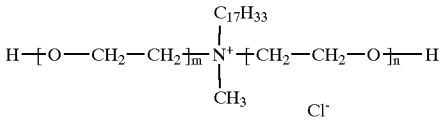

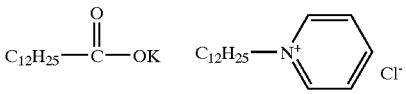

The particulate polymer used in the heat-sensitive layer in the planographic printing plate precursor of the invention can also make use of particulate polymers containing compounds having the functional groups as described above. As described above regardless of whether high- or low-molecular compounds, any compounds having the functional groups can be used, among which compounds having a molecular weight of 5000 or less are preferable. Examples of such compounds include the following compounds. However, these examples are not intended to limit the invention.

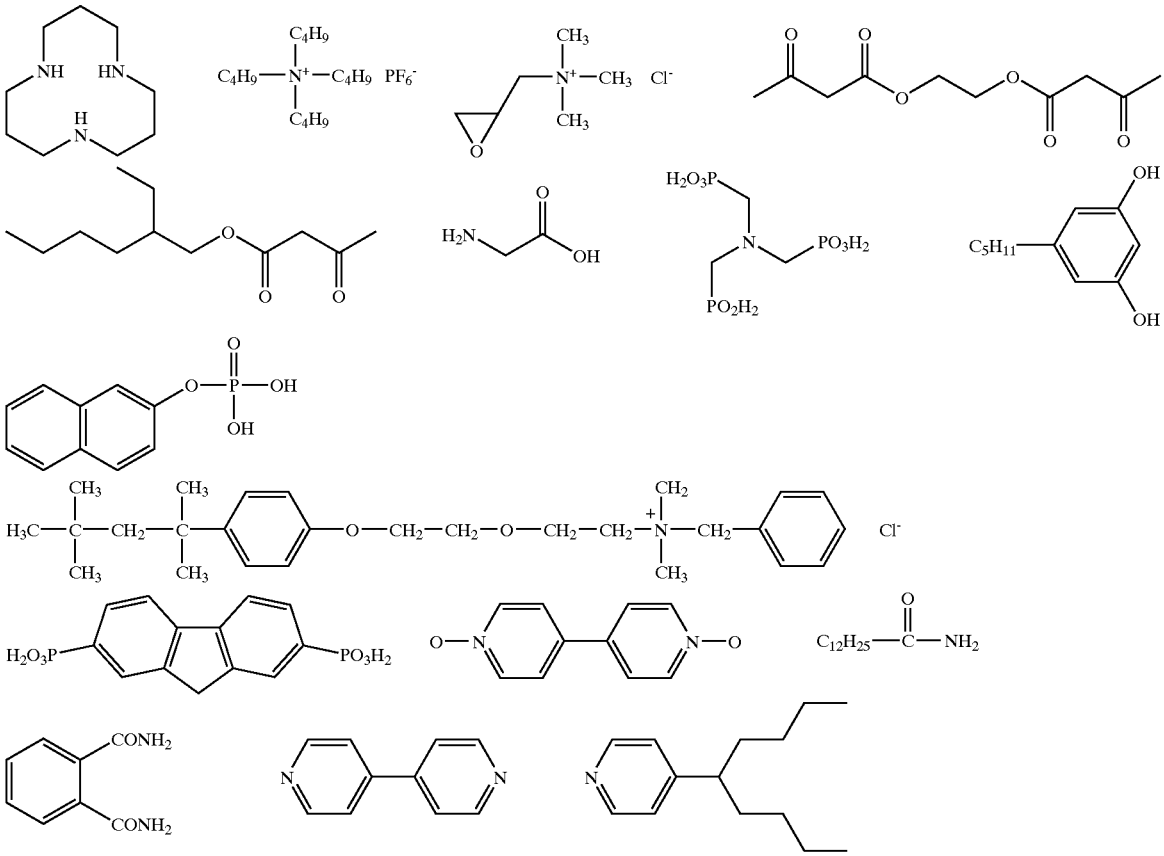

The particulate polymers containing these compounds can also be prepared by mixing these compounds with the monomer added in emulsion polymerization and suspension polymerization, or by dissolving these compounds together with a polymeric compound in an organic solvent, adding an emulsifier or dispersant to dissolve or disperse them in water, and removing the organic solvent by evaporation.

The weight-average molecular weight, as determined by GPC, of the resin constituting particulate polymers having functional groups interacting with the hydrophilic surface of the substrate used in the planographic printing plate precursor of the invention is preferably 2000 or more, more preferably in the range of 5,000 to 2,000,000, and the number-average molecular weight thereof is preferably 800 or more, more preferably in the range of 1,000 to 2,000,000. The degree of polydispersion (=weight-average molecular weight/number-average molecular weight) is preferably 1 or more, more preferably in the range of 1.1 to 10.

The resin having functional groups interacting with the hydrophilic surface may be made of a random polymer, block polymer or graft polymer, preferably a random polymer.

The solvent used for synthesizing the resin having such functional groups or fine particles thereof includes tetrahydrofuran, ethylene dichloride, cyclohexanone, methyl ethyl ketone, acetone, methanol, ethanol, ethylene glycol monomethyl ether, ethylene glycol monoethyl ether, 2-methoxyethyl acetate, diethylene glycol dimethyl ether, 1-methoxy-2-propanol, 1-methoxy-2-propyl acetate, N,N-dimethyl formamide, N,N-dimethyl acetamide, toluene, ethyl acetate, ethyl lactate, methyl lactate, dimethyl sulfoxide, and water. These solvents may be used alone or two or more as a mixture thereof.

The radical polymerization initiator for synthesizing the resin constituting particulate polymers, or fine polymer particles themselves, used in the heat-sensitive layer in the planographic printing plate precursor of the invention can make use of known compounds such as an azo-type initiator and a peroxide initiator.

When a substrate having a hydrophilic surface on which hydrophilic graft polymer chains described later in detail are present is used as the substrate of the invention, the resin preferably has the functional groups particularly those interacting with the hydrophilic graft polymers, and examples of such functional groups include e.g. a basic functional group such as amino group and pyridyl group; a quaternary ammonium group; a hydroxyl group; an acidic functional group such as carboxyl group and sulfonate group; and a hydrogen-bonding functional group such as amide group, from which the functional groups can be selected.

The functional groups used are selected in consideration of the type of functional groups in graft polymers present on the hydrophilic surface. That is, the functional groups used should be selected from the viewpoint of the easiness and degree of interaction thereof with the graft polymers. For example, when the graft polymers are acrylic acid grafts, the functional groups introduced into the polymers for forming the heat-sensitive layer are selected preferably from functional groups capable of interacting with acrylic acid, specifically functional groups such as an amino group, pyridyl group, quaternary ammonium group and amide group. When the graft polymers are acrylamide grafts, carboxyl groups capable of interacting with the acrylamide should be selected as the functional groups introduced into the polymers for forming the heat-sensitive layer.

The form of thermoplastic particulate polymer used in forming images include the particulate polymers described above, and thermoplastic particulate polymers described in Research Disclosure No. 33303 in January 1992, Japanese Patent Application Laid-Open (JP-A) Nos. 9-123387, 9-131850, 9-171249, 9-171250 and EP931647 can also be mentioned as preferable ones.

Examples thereof include homopolymers or copolymers of monomers such as ethylene, styrene, vinyl chloride, methyl acrylate, ethyl acrylate, methyl methacrylate, ethyl methacrylate, vinylidene chloride, acrylonitrile, vinyl carbazole, or mixtures of such homopolymers or copolymers. More preferable among these polymers are polystyrene and poly(methyl methacrylate). As the particulate polymers used in the invention, copolymers produced by copolymerizing these thermoplastic particulate polymers with monomers having functional groups capable of interacting with the graft polymers can be used. Homopolymers consisting of monomers having functional groups capable of interacting with the graft polymers can also be used. However, the copolymers are selected more preferably from the viewpoint of easy control of heat fusion temperature.

The monomers having functional groups capable of interacting with the hydrophilic graft polymers, which can be used in the invention, include monomers containing an amino group and quaternary ammonium, such as 2-diethyl aminoethyl acrylic acid, 2-dimethyl aminoethyl acrylic acid, 2-diethyl aminoethyl methacrylic acid, 2-dimethyl aminoethyl methacrylic acid, 2-triethyl ammonium ethyl acrylic acid, 2-trimethyl ammonium ethyl acrylic acid, 2-triethyl ammonium ethyl methacrylic acid, 2-trimethyl ammonium ethyl methacrylic acid, dimethyl aminomethyl styrene, tetramethyl ammonium methyl styrene, diethyl aminomethyl styrene and tetraethyl ammonium methyl styrene; amide monomers such as acrylamide, N-vinyl pyrrolidone and N-vinyl acetamide; carboxylic acid polymers such as acrylic acid and methacrylic acid; hydroxyl group monomers such as 2-hydroxyethyl methacrylic acid; and sulfonic acid group monomers such as styrene sulfonic acid.

The monomers not having such interacting functional groups, which can be copolymerized with these monomers, include e.g. styrene, alkyl acrylate, alkyl methacrylate, acrylonitrile and vinylacetate, but are not limited insofar as the monomers do not have interacting functional groups.

When the polymerization is followed by introduction of the thermally reactive functional groups, the polymer reaction described in e.g. WO 96-34316 can be used.

Among the particulate polymers described above, those easily fused by heating are preferable from the viewpoint of image formation as the thermoplastic particulate polymers used in the heat-sensitive layer of the invention, and from the viewpoint of development performance on machine, those rendered water-dispersible by the hydrophilicity of the surface thereof are particularly preferable.

As the criterion of the hydrophilicity of the surface of the particulate polymer, the contact angle (of a water drop) on a film prepared by applying only the particulate polymer and drying the polymer at a temperature lower than the heat fusion temperature thereof is preferably lower than the contact angle (of a water drop) on a film prepared by drying said polymer at a temperature higher than the heat fusion temperature. To confer such preferable hydrophilicity on the surface of the particulate polymer, hydrophilic polymers such as polyvinyl alcohol and polyethylene glycol or oligomers, or hydrophilic low-molecular compounds, may be adsorbed onto the surface of the particulate polymer, but the method of rendering the surface of the particulate polymer hydrophilic is not particularly limited, and a wide variety of known methods of rendering the surface hydrophilic can be used.

The heat fusion temperature of the thermoplastic particulate polymer having specific reactive functional groups is preferably 70° C. or more, more preferably 80° C. or more in consideration of stability with time. However, the polymer having a too high heat fusion temperature is not preferable from the viewpoint of sensitivity, so its heat fusion temperature is preferably in the range of 80 to 250° C., more preferably 100 to 150° C.

The average particle diameter of the particulate polymer is preferably 0.01 to 20 $\mu$m, more preferably 0.05 to 2.0 $\mu$m and most preferably 0.1 to 1.0 $\mu$m. When the average particle diameter is in the range of 0.01 to 20 $\mu$m, a planographic printing plate precursor excellent in resolution, stability with time and development performance can be obtained.

The amount of the particulate polymer having such reactive functional groups is preferably 50 to 98% by weight, more preferably 60 to 95% by weight, relative to the solids content of the heat-sensitive layer.

In the heat-sensitive layer of the invention, microcapsules containing a compound having such functional groups can also be used preferably as the image-forming material.

(b) Microcapsules containing a compound having, in the molecule, functional groups capable of interacting with the hydrophilic surface The microcapsules used in the invention contain a compound having functional groups capable of interacting with the hydrophilic surface. The compound having such interacting functional groups is in a chemical form such as monomer, prepolymer, that is, dimer, trimer and oligomer, or a mixture thereof, or a copolymer thereof.

Specifically, the compound having functional groups capable of interacting with the hydrophilic surface includes not only a polymer having at least one reactive functional group exemplified above for the thermoplastic particulate polymer, but also the low-molecular compound having reactive functional groups exemplified above. In particular, the polymer having functional groups capable of interacting with the hydrophilic surface is preferably used from the viewpoint of heat fusion.

For encapsulating the compound having functional groups capable of interacting with the hydrophilic surface, conventional methods of forming microcapsules can be used. For example, the method of producing microcapsules includes, but is not limited to, a method of utilizing coacervation as shown in U.S. Pat. Nos. 2,800,457 and 2,800,458, a method of interfacial polymerization as shown in GB Patent No. 990,443, U.S. Pat. No. 3,287,154, Japanese Patent Application Publication (JP-B) No. Nos. 38-19574, 42-446 and 42-711, a method of precipitating polymers as shown in U.S. Pat. Nos. 3,418,250 and 3,660,304, a method of using an isocyanate polyol wall material as shown in U.S. Pat. No. 3,796,669, a method of using an isocyanate wall material as shown in U.S. Pat. No. 3,914,511, a method of using an urea-formaldehyde type or urea-formaldehyde-resorcinol type wall-forming material as shown in U.S. Pat. Nos. 4,001,140, 4,087,376 and 4,089,802, a method of using a wall material such as melamine-formaldehyde resin and hydroxy cellulose as shown in U.S. Pat. No. 4,025,445, a method of in situ polymerization of monomers as shown in JP-B Nos. 36-9163 and 51-9079, a method of spray drying as shown in BG Patent No. 930,422 and U.S. Pat. No. 3,111,407, and a method of electrolytic dispersion cooling as shown in GB Patent Nos. 952,807 and 967,074.

The microcapsule wall used in the invention preferably has 3-dimensional crosslinkages to be swollen with a solvent. From such a viewpoint, the wall material for the microcapsules is preferably polyurea, polyurethane, polyester, polycarbonate, polyamide and a mixture thereof among which polyurea and polyurethane are particularly preferable. The compound having the thermally reactive functional groups may be introduced into the microcapsule wall.

The average particle diameter of the microcapsules is preferably 0.01 to 20 μm, more preferably 0.05 to 2.0 μm and most preferably 0.10 to 1.0 μm. When the average particle diameter is in the range of 0.01 to 20 μm, a planographic printing plate precursor excellent in resolution, stability with time and development performance can be obtained. If the average particle diameter is too large, the resolution is deteriorated, while if it is too small, the stability with time is deteriorated.

Such microcapsules may or may not be fused with one another by heating.

In this embodiment, the microcapsule materials, the compounds contained therein, and other arbitrary components present in the heat-sensitive layer having the microcapsules dispersed therein may react with each other to form an image-forming region, that is, a hydrophobic region (ink-philic region), and examples of such materials include thermally fusing microcapsules; thermochemically reacting compounds such as a material on the surface of the microcapsule or a material oozing upon application from the microcapsule, or a compound penetrating into the microcapsule wall; compounds reacting with hydrophilic resin containing the microcapsule materials with the compounds contained therein or reacting with the low-molecular compound added; and two or more kinds of microcapsule materials (or materials contained therein) having different and thermally reacting functional groups by which the microcapsules are mutually reacted.

Accordingly, heat fusion of the microcapsules is preferable but not essential for image formation.

As shown in this embodiment, the compound having, in the molecule thereof, functional groups capable of interacting with the hydrophilic surface is incorporated into the microcapsules, whereby the compound capable of interacting with the hydrophilic surface is separated by the microcapsule wall thereby preventing undesired interaction thereof with the surface of the substrate. By permitting the image-forming compound not heated or in a non-heated region to be contained in the microcapsules and to remain separated, smuts generated due to interaction of the image-forming compound with the hydrophilic graft polymers on the hydrophilic surface can be prevented in the non-image part (non-heated region), and smuts if any can be easily removed, and generation of smuts in the non-image part can be prevented and development performance on machine can be further improved.

The amount of the microcapsules added to the heat-sensitive layer is preferably 50 to 98% by weight, more preferably 60 to 95% by weight, in terms of solids content. In this range, good development performance on machine and good sensitivity and printing resistance can be achieved.

When the microcapsules are added to the heat-sensitive layer, a solvent in which the contained materials are dissolved while the wall material is swollen can be added to the dispersant of the microcapsules. By such solvent, the diffusion of the contained compounds having the thermally reacting functional groups from the microcapsules can be promoted.

Such solvent is selected depending on the dispersant of the microcapsules, the material of the microcapsule wall, the thickness of the wall, and the materials contained therein, and can be easily selected from a large number of commercially available solvents. For example, alcohols, ethers, acetals, esters, ketones, polyvalent alcohols, amides, amines, and aliphatic acids are preferable for water-dispersible microcapsules made of crosslinked polyurea or polyurethane wall.

Examples of such solvents include, but are limited to, methanol, ethanol, tertiary butanol, n-propanol, tetrahydrofuran, methyl lactate, ethyl lactate, methyl ethyl ketone, propylene glycol monomethyl ether, ethylene glycol diethyl ether, ethylene glycol monomethyl ether, y-butyrolactone, N,N-dimethylformamide and N,N-dimethylacetamide. Two or more of these solvents may also be used.

A solvent not dissolved in the dispersant of the microcapsules but dissolved as a mixture with another solvent can also be used. The amount of the solvent added shall be determined depending on the combination of the materials used, but when the amount of the solvent is lower than suitable, image formation is inadequate, and when the amount is too high, the stability of the dispersant is deteriorated. Usually, the effective amount of the solvent is 5 to 95% by weight of the coating solution, preferably in the range of 10 to 90% by weight, more preferably 15 to 85% by weight.

Other Components

In the heat-sensitive layer according to the invention, the particulate polymers and microcapsules capable of forming images can be used in combination with various additives depending on the intended object.

Hydrophilic Resin

Hydrophilic resin may be added to the heat-sensitive layer of the invention. By adding the hydrophilic resin, the development performance on machine becomes good, and the film strength of the thermoplastic layer itself is also improved.

For example, the hydrophilic resin is a resin preferably having a hydrophilic group such as hydroxyl, carboxyl, hydroxyethyl, hydroxypropyl, amino, aminoethyl, aminopropyl and carboxymethyl.

Examples of the hydrophilic resin include gum arabic, casein, gelatin, starch derivatives, carboxymethyl cellulose and sodium salts thereof, cellulose acetate, sodium alginate, vinyl acetate-maleic acid copolymers, styrene-maleic acid copolymers, polyacrylic acids and salts thereof, polymethacrylic acids and salts thereof, hydroxyethyl methacrylate homopolymers and copolymers, hydroxyethyl acrylate homopolymers and copolymers, hydroxypropyl methacrylate homopolymers and copolymers, hydroxypropyl acrylate homopolymers and copolymers, hydroxybutyl methacrylate homopolymers and copolymers, hydroxybutyl acrylate homopolymers and copolymers, polyethylene glycols, hydroxypropylene polymers, polyvinyl alcohols, polyvinyl acetate hydrolyzed at least 60% by weight, preferably at least 80% by weight, polyvinyl formal, polyvinyl butyral, polyvinyl pyrrolidone, acrylamide homopolymers and copolymers, methacrylamide homopolymers and copolymers, and N-methylol acrylamide homopolymers and copolymers.

The amount of the hydrophilic resin added to the heat-sensitive layer is preferably 5 to 40% by weight, more preferably 10 to 30% by weight, relative to the solids content of the photosensitive layer. In this range, good development performance on machine and film strength can be achieved.

Light-heat Converting Agent

Preferably, the planographic printing plate precursor of the invention contains a light-heat converting agent for converting light energy into heat energy when the planographic printing plate precursor is used for forming images by scanning exposure to laser light.

The light-heat converting agent which maybe contained in the planographic printing plate precursor of the invention may be any materials which can absorb UV rays, visible rays, IR rays or white light to convert them into heat, and examples thereof include carbon black, carbon graphite, pigment, phthalocyanine type pigment, metal powder and metal compound powder. Particularly preferable is a dye, pigment, metal powder or metal compound powder efficiently absorbing IR rays at wavelengths in the range of 760 to 1200 nm.

The dye may be any commercial dye including known dyes described in e.g. "Senryo Binran" (Dye Handbook) (published in 1970 and compiled by Society of Synthetic Organic Chemistry, Japan). Examples of such dyes include azo dyes, metal complex salt azo dyes, pyrazolone azo dyes, anthraquinone dyes, phthalocyanine dyes, carbonium dyes, quinone imine dyes, methine dyes, cyanine dyes and metal thiolate complexes. Preferable dyes include e.g. the cyanine dyes described in JP-A Nos. 58-125246, 59-84356, 59-202829, 60-78787 etc., the methine dyes described in JP-A Nos. 58-173696, 58-181690, 58-194595 etc., the naphthoquinone dyes described in JP-A Nos. 58-112793, 58-224793, 59-48187, 59-73996, 60-52940, 60-63744 etc., the squawarylium (phonetic) pigments described in JP-A No. 58-112792 etc., and the cyanine dyes described in GB Patent No. 434,875.

Further, the near infrared ray-absorbing sensitizer described in U.S. Pat. No. 5,156,938 is also preferably used, and also preferably used are the substituted aryl benzo(thio) pyrylium salts described in U.S. Pat. No. 3,881,924, the trimethine thiapyrylium salts described in JP-A No. 57-142645 (U.S. Pat. No. 4,327,169), the pyrylium type compounds described in JP-A Nos. 58-181051, 58-220143, 59-41363, 59-84248, 59-84249, 59-146063, and59-146061, the cyanine pigments described in JP-A No. 59-216146, the pentamethine thiopyrylium salts described in U.S. Pat. No. 4,283,475, and thepyrylium compounds described in JP-B Nos. 5-13514 and 5-19702.

Other preferable examples of dyes include the near infrared ray-absorbing dyes of formulae (I) and (II) described in U.S. Pat. No. 4,756,993.

Particularly preferable dyes among those described above are the cyanine pigments, squawarylium (phonetic) pigments, pyrylium salts, and nickel-thiolate complexes.

The pigment usable preferably as the light-heat converting agent in the invention includes commercial pigments and those described in Color Index (C. I.) Handbook, "Saishin Ganryo Binran" (Newest Pigment Handbook) (published in 1977 and compiled by Japanese Society of Pigment Technology), "Saishin Ganryho Oyo Gijyutsu" (Newest Pigment Applied Technology) (published in 1986 by CMC), and "Insatsu Inki Gijyutsu" (Printing Ink Technology) (published in 1984 by CMC).

As the type of pigment, mention is made of black pigments, yellow pigments, orange pigments, brown pigments, red pigments, violet pigments, blue pigments, green pigments, fluorescent pigments, metallic powder pigments, and other pigments such as polymer-binding pigments. Specifically, it is possible to use insoluble azo pigments, azo lake pigments, condensed azo pigments, chelate azo pigments, phthalocyanine type pigments, anthraquinone type pigments, perylene and perinone type pigments, thioindigo type pigments, quinacridone type pigments, dioxazine type pigments, isoindolinone type pigments, quinophthalone type pigments, dyed lake pigments, azine pigments, nitroso pigments, nitro pigments, natural pigments, fluorescent pigments, inorganic pigments, carbon black etc. A preferable pigment among those described above is carbon black.

In the heat-sensitive layer of the invention, metal fine particles can also be used as the light-heat converting agent. The metal fine particles may be any metal fine particles which upon light irradiation, are thermally fused by their light-heat converting properties, and metals constituting the fine particles are preferably fine particles of a metal element selected from the groups 8 and 1B or an alloy thereof, more preferably fine particles of a metal element selected from Ag, Au, Cu, Pt and Pd or an alloy thereof.

The average diameter of the metal fine particles usable in the invention is preferably 1 to 500 nm, more preferably 1 to 100 nm and particularly preferably 1 to 50 nm. The dispersion may be polydisperse but is preferably monodisperse with a variation coefficient of 30% or less.

When the light-heat converting agent added to the heat-sensitive layer is a pigment or dye, it can be added in an amount of up to 30% by weight of the solids content of the heat-sensitive layer. The amount is preferably 1 to 25% by weight, particularly preferably 7 to 20% by weight.

The content of the metal fine particle-based heat-light converting agent is about 5 to 50% by weight, preferably 10 to 30% by weight and particularly preferably 15 to 20% by weight of the solids content of the image-forming material. In this range, an excellent effect of improving sensitivity can be achieved.

Other Additives

In addition to the additives described above, other various compounds may be added if necessary to the heat-sensitive layer of the invention. For example, a multifunctional monomer can be added to the matrix of the heat-sensitive layer in order to further improve printing resistance. As the multifunctional monomer, the monomers exemplified as those contained in the microcapsules can be used. Particularly preferable monomers include trimethylol propane triacrylate.

In the heat-sensitive layer of the invention, a dye having considerable absorption in the visible-light range can be used as a coloring agent for images in order to facilitate distinction of an image portion from a non-image portion after images are formed. Specifically, mention can be made of Oil Yellow #101, Oil Yellow #103, Oil Pink #312, Oil Green BG, Oil Blue BOS, Oil Blue #603, Oil Black BY, Oil Black BS, Oil Black T-505 (which are available from Orient Chemical Industries, Ltd.), Victoria Pure Blue, Crystal Violet (CI42555), Methyl Violet (CI42535), Ethyl Violet, Rhodamine B (CI145170B), Malachite Green (CI42000) Methylene Blue (CI52015) etc. Further, the dyes described in JP-A No. 62-293247 are particularly preferable. Further, phthalocyanine type pigments, azo type pigments, and titanium oxide pigments can be preferably used. The ratio of such dyes to the solids content of a heat-sensitive layer coating solution is 0.01 to 10% by weight.

Formation of the Heat-sensitive Layer

The heat-sensitive layer of the invention is prepared by dissolving or dispersing the necessary components in a solvent to prepare a coating solution and then applying the solution onto the hydrophilic surface of the substrate described later.

The solvent used includes, but is not limited to, ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy- 2-propyl acetate, dimethoxyethane, methyl lactate, ethyl lactate, N,N-dimethyl acetamide, N,N-dimethylformamide, tetramethyl urea, N-methyl pyrrolidone, dimethyl sulfoxide, sulfolane, γ-butyrolactone, toluene and water. These solvents are used singly or as a mixture thereof. The concentration of the respective components in the coating solution is preferably 1 to 50% by weight.

The amount (solids content) of the respective components in the heat-sensitive layer coated and dried on the substrate is varied depending on the intended use, but generally the amount is preferably 0.5 to 5.0 g/m$^2$. When the amount is less than this range, the apparent sensitivity is improved, but the film characteristics of the heat-sensitive layer fulfilling the image-recording function are lowered.

For coating, various methods can be used. For example, bar coating, rotational coating, spray coating, curtain coating, dip coating, air knife coating, blade coating and roll coating can be mentioned.

Other Constituent Elements

Overcoat Layer

In the planographic printing plate precursor of the invention, a water-soluble overcoat layer may be arranged on the heat-sensitive layer in order to prevent the pollution of the surface of the heat-sensitive layer with a lipophilic substance. Preferably, the water-soluble overcoat layer used in the invention is easily removable just before printing and contains a resin selected from water-soluble organic polymeric compounds.

The water-soluble organic polymeric compound is applied and dried to give a film, and examples of such polymeric compounds include polyvinyl acetate (with a degree of hydrolysis of 65% or more), polyacrylic acid and an alkali metal salt or amine salt thereof, a polyacrylic acid copolymer and an alkali metal salt or amine salt thereof, polymethacrylic acid and an alkali metal salt or amine salt thereof, a polymethacrylic acid copolymer and an alkali metal salt or amine salt thereof, polyacrylamide and a copolymer thereof, polyhydroxyethyl acrylate, polyvinyl pyrrolidone and a copolymer thereof, polyvinylmethyl ether, a polyvinylmethyl ether/maleic anhydride copolymer, poly-2-acrylamide-2-methyl-1-propane sulfonic acid and an alkali metal salt or amine salt thereof, a poly-2-acrylamide-2-methyl-1-propane sulfonic acid copolymer and an alkali metal salt or amine salt thereof, gum arabic, fibrin derivatives (for example, carboxymethyl cellulose, carboxyethyl cellulose, methyl cellulose etc.) and modifications thereof, white dextrin, pullulan, and enzymatically hydrolyzed etherified dextrin. Depending on the object, two or more of these resins can be mixed for use.

Out of the light-heat converting agents described above, the water-soluble one may be added to the overcoat layer. For the purpose of certainly making the overcoat layer uniform, a nonionic surfactant such as polyoxyethylene nonyl phenyl ether or polyoxyethylene dodecyl ether can be added when the aqueous coating solution is applied.

The amount of the overcoat layer after drying is preferably 0.1 to 2.0 g/m$^2$. In this range, the development performance on machine is not deteriorated, and the pollution of the surface of heat-sensitive layer with lipophilic substances such as smuts including fingerprints can be well prevented.

Substrate Having a Hydrophilic Surface

The substrate used in the planographic printing plate precursor of the invention is not particularly limited insofar as it has such hydrophilicity as to receive moistening water in printing, to form the non-image part. Typical examples include an aluminum substrate whose surface has been subjected to hydrophilic treatment used often for conventional planographic printing plate precursors, or a substrate having a hydrophobic surface on which hydrophilic graft polymers capable of expressing excellent hydrophilicity are present as described later.

1. Aluminum Substrate

The aluminum substrate used in the invention is a substrate made of a metal based on dimensionally stable aluminum, that is, a substrate of aluminum or an aluminum alloy. The aluminum substrate is selected from a pure aluminum plate, an aluminum-based alloy plate containing a very small amount of other elements, and a plastic film or paper having aluminum (alloy) laminated or deposited thereon. Further, a composite sheet having an aluminum sheet bound onto a polyethylene terephthalate film as described in JP-B No. 48-18327 may also be used.

In the following description, the substrate comprising aluminum or an aluminum alloy or the substrate having a layer comprising aluminum or an aluminum alloy as described above is referred to collectively as the aluminum substrate.

Other elements contained in the aluminum alloy include silicon, iron, manganese, copper, magnesium, chromium, zinc, bismuth, nickel, titanium etc., and the content of the other elements in the alloy is up to 10% by weight. In the invention, the substrate is particularly preferably a pure aluminum plate, but because production of absolutely pure aluminum by refining techniques is difficult, aluminum may contain a very small amount of other elements.

The aluminum plate used in the invention is not the one whose composition can be specified, and known conventional materials such as JIS A 1050, JIS A 1100, JIS A 3103 and JIS A 3005 can be suitably used. The thickness of the aluminum substrate used in the invention is about 0.1 to 0.6 mm. The thickness can be suitably changed depending on the size of the printer or printing matrix.

The aluminum substrate is subjected to various surface treatments described below to give an aluminum substrate.

Graining Treatment

The aluminum plate is subjected to graining in a more preferably form. The graining method includes mechanical graining, chemical etching and electrolytic graining as disclosed in JP-A No. 56-28893. The methods of mechanical graining include an electrochemical graining method of electrochemical graining in an electrolyte such as hydrochloric acid or nitric acid, a wire brush graining method of scratching an aluminum surface with a metallic wire, a ball graining method of graining an aluminum surface with an abrading ball and an abrading agent, and a brush graining method of graining the surface with a nylon brush and an abrading agent, and these graining methods can be used alone or in combination thereof.

Etching Treatment

After the aluminum substrate thus grained is subjected to chemical etching with an acid or alkali. Use of an acid as the etching agent is disadvantageous to application of the invention to industrial use because destruction of the fine structure is time-consuming, and this problem can be solved by using an alkali as the etching agent.

The alkali agent, which can be used preferably in etching in the invention, includes caustic soda, sodium carbonate, sodium aluminate, sodium metasilicate, sodium phosphate, potassium hydroxide and lithium hydroxide. When these alkali agents are used in etching, the concentration and temperature are preferably in the range of 1 to 50% and 20 to 100° C., respectively, and the amount of aluminum dissolved under preferable conditions is 5 to 20 g/m$^3$.

After etching, the surface thereof is pickled to remove smuts remaining thereon. The acid used includes nitric acid, sulfuric acid, phosphoric acid, chromic acid, fluoric acid and borofluoric acid. In particular, the method of removing smuts after electrochemical surface-roughing includes a method of contacting the surface with 15 to 65 weight % sulfuric acid at a temperature of 50 to 90° C. as described in JP-A No. 53-12739 and a method of alkali etching described in JP-B No. 48-28123.

Anodization

The aluminum substrate thus treated is further subjected to anodization treatment. The anodization can be conducted in a method known in the art. Specifically, an anodized film canbe formed on the surface of the aluminum substrate by direct current or alternating current through the aluminum in an aqueous or non-aqueous solution of alone such as sulfuric acid, phosphoric acid, chromic acid, oxalic acid, sulfamic acid or benzenesulfonic acid or a mixture thereof. The electrolyte may also contain at least components usually contained in the Al alloy plate, electrodes, tap water and ground water. Further, second and third components may be added. The second and third components include e.g. metal ions such as Na, K, Mg, Li, Ca, Ti, Al, V, Cr, Mn, Fe, Co, Ni, Cu and Zn; cations such as ammonium ion; and anions such as nitrate ion, carbonate ion, chlorine ion, phosphate ion, fluorine ion, sulfite ion, titanate ion, silicate ion and borate ion, and these ions may be contained at a level of 0 to about 10,000 ppm. The conditions for this anodic treatment shall be selected depending on the electrolyte used, but it is usually preferable that the concentration of the electrolyte is 1 to 80% by weight, the temperature of the solution is −5 to 70° C., the current density is 0.5 to 60 A/dm$^2$, the voltage is 1 to 100 V, and the electrolysis time is 10 to 200 seconds.

The anodized film formed in the invention is preferably in the range of 1 to 10 g/m$^2$, and if the anodized film is less than 1 g/m$^2$, the plate is easily marred, while an anodized film in an amount of greater than 10 g/m$^2$ is economically disadvantageous because much electricity is required for production. The anodized film is preferably 1.5 to 7 g/m$^2$, more preferably 2 to 5 g/m$^2$.

Hydrophilicity-conferring Treatment

The aluminum substrate after subjected to anodization as described above is treated to make the surface thereof hydrophilic. The hydrophilicity-conferring treatment used in the invention includes an alkali metal silicate method of using e.g. an aqueous solution of sodium silicate as disclosed in U.S. Pat. Nos. 2,714,066, 3,181,461, 3,280,734 and 3,902,734. In this method, the substrate is dipped or hydrolyzed in an aqueous solution of sodium silicate. Alternatively, a method of treatment with potassium fluorozirconate as disclosed in JP-B No. 36-22063 and a method of treatment with polyvinyl phosphonic acid as disclosed in U.S. Pat. Nos. 3,276,868, 4,153,461, and 4,689,272 can be used.

Prime-coat Layer

In the planographic printing plate precursor of the invention, a prime-coat layer may be arranged if necessary between the substrate and the heat-sensitive layer, to form a hydrophilic surface. In this case, the above-described hydrophilicity-conferring treatment can be omitted.

The prime-coat components may be various organic compounds such as carboxymethyl cellulose, dextrin, gum arabic, phosphonic acids having an amino group, such as 2-aminoethyl phosphonic acid, substituted or non-substituted organic phosphonic acids such as phenyl phosphonic acid, naphthyl phosphonic acid, alkyl phosphonic acid, glycerophosphonic acid, methylene diphosphonic acid and ethylene diphosphonic acid, substituted or non-substituted organic phosphoric acids such as phenyl phosphoric acid, naphthyl phosphoric acid, alkyl phosphoric acid and glycerophosphoric acid, substituted or non-substituted organic phosphinic acids such as phenyl phosphinic acid, naphthyl phosphinic acid, alkyl phosphinic acid and glycerophosphinic acid, amino acids such as glycine and β-alanine, and hydroxyl group-containing amine hydrochlorides such as triethanolamine hydrochloride, and these may be used in combination two or more thereof.

2. Substrate Having a Hydrophilic Surface on Which Hydrophilic Graft Polymers are Present Preferable examples of the substrate in the invention include not only the aluminum substrate subjected to hydrophilicity-conferring treatment or having an organic prime-coat layer formed thereon, but also a substrate having a hydrophilic surface on which hydrophilic graft polymers described later in detail are present to express excellent hydrophilic properties.

In the present invention, the substrate used in forming a hydrophilic surface on which hydrophilic graft polymers are present is not particularly limited insofar as the substrate is a dimensionally stable plate and has necessary flexibility, strength, durability etc., and examples thereof include a paper, a paper with plastics (e.g., polyethylene terephthalate, polyethylene, polypropylene, polystyrene etc.) laminated thereon, a metal plate (e.g., aluminum, zinc, copper etc.), a plastic film (e.g., diacetate cellulose, triacetate cellulose, propionate cellulose, butyrate cellulose, acetate butyrate cellulose, nitrate cellulose, polyethylene terephthalate, polyethylene, polystyrene, polypropylene, polycarbonate, polyvinyl acetal etc.) and a paper or plastic film having the above metal laminated or deposited thereon. The substrate in the invention is preferably a polyester film or an aluminum plate.

States of the Surface of the Substrate

The substrate used for forming a hydrophilic surface comprising graft polymers is preferably a substrate having a roughened surface to serve as the hydrophilic surface, from the viewpoint of improving the adhesion thereof to a heat-sensitive layer arranged thereon. Hereinafter, preferable states of the surface of the substrate (solid surface) used in the invention are described.

Preferable states of the roughening of the substrate used in the invention are that as 2-dimensional roughness parameters, the central line average roughness (Ra) is 0.1 to 1 μm, the maximum height (Ry) is 1 to 10 μm, the ten-point average roughness (Rz) is 1 to 10 μm, the unevenness average distance (Sm) is 5 to 80 μm, the average distance between local mountaintops (S) is 5 to 80 μm, the maximum height (Rt) is 1 to 10 μm, the central line mountain height (Rp) is 1 to 10 μm, and the central line hollow depth (Rv) is 1 to 10 μm, and the surface of the substrate is a surface satisfying preferably one of these requirements, more preferably all these requirements.

The 2-dimensional roughness parameters described above are based on the following definition.

Central line average roughness (Ra): The value obtained by extracting the measurement length L in the direction of the central line from the roughness curve and then determining the arithmetical average absolute value of the deviation between the extracted central line and the roughness curve.

Maximum height (Ry): The value obtained by extracting the standard length in the direction of the average line from the roughness curve and then determining the distance between the mountaintop line and bottom line in this extracted portion, in the direction of lengthwise magnification of the roughness curve.

Ten-point average roughness (Rz): The value obtained by extracting the standard length in the direction of the average absolute value from the roughness curve, then determining the sum of the average absolute value of the elevation (Yp) of from the 1st to 5th highest mountaintops and the average absolute value of the elevation (Yv) of from the 1st to 5th lowest bottoms measured from the average line to axial magnification direction in this extracted portion, and expressing the sum in micrometer (μm).

Unevenness average distance (Sm): The value obtained by extracting the standard length in the direction of the average line from the roughness curve, determining the sum of average lines corresponding to one mountain and its adjacent bottoms in this extracted portion, and expressing the arithmetical average distance among a plurality of such convex and concave regions in micrometer (μm).

Average distance between local mountaintops (S): The value obtained by extracting the standard length in the direction of the average line from the roughness curve, determining the length of the average line between adjacent mountaintops in this extracted portion and expressing the arithmetical average distance among a plurality of local mountaintops in micrometer (μm).

Maximum height (Rt): The value obtained by extracting the standard length from the roughness curve and determining the distance between 2 straight lines by which the extracted portion is sandwiched and which is parallel to the central line in this extracted portion.

Central line height (Rp): The value obtained by extracting the measurement length L in the direction of the central line from the roughness curve and determining the distance between straight lines passing through the maximum mountaintop and parallel to the central line in this extracted portion.

Central line hollow depth (Rv): The value obtained by extracting the measurement length L in the direction of the central line from the roughness curve and determining the distance between straight lines passing through the lowest bottom and parallel to the central line in this extracted portion.

(A) Substrate Having a Hydrophilic Surface on Which Hydrophilic Graft Polymer Chains are Present First, the hydrophilic surface of the substrate is described.

The hydrophilic surface of the substrate in the invention refers to a surface on which hydrophilic graft polymer chains are present, wherein the hydrophilic graft polymer chains may be bound directly to the surface of the substrate, or a polymeric compound whose side chains have hydrophilic graft polymer chains may be bound to the surface of the substrate, or the hydrophilic graft polymer chains may be arranged on the surface by coating or coating and subsequent crosslinkage. In the invention, the hydrophilic graft polymer chain bound directly to the surface of the substrate is referred to as "surface graft", and a crosslinked polymer coating into which hydrophilic graft polymer chains were introduced is referred to as "crosslinked hydrophilic layer into which hydrophilic graft chains were introduced".

Method of Forming the Surface Graft

The method of providing the substrate thereon with a graft polymer surface having hydrophilic groups may be a method known in the art, such as Shinji Arai: "Macromoner Niyoru Hyomen Kaishitsu To Secchaku" (Surface Modification and Adhesion by Macromonomers), Journal of Society of Rubber Industry, Japan, 65, 604 (1992). Alternatively, a method called a surface graft polymerization method described below can be used.

Description of the Surface Graft Method

The surface formed by the surface graft method refers to a polymer surface having monomers grafted onto it by light, electron rays or heat in a method known in the art. The monomers may be any positively charged monomers such as ammonium and phosphonium; monomers having negatively charged groups such as sulfonate group, carboxyl group, phosphate group and phosphonate group; monomers having acid groups which can be dissociated to form negatively charged groups; and monomers having nonionic groups such as hydroxyl group, amide group, sulfonamide group, alkoxy group and cyano group.

The surface graft polymerization method is a method of synthesizing a graft polymer on a chain of a polymeric compound, which is initiated by giving an active species to the chain, and particularly when the polymeric compound given an active species forms a solid surface, the method is called surface graft polymerization.

The surface graft polymerization method for realizing the invention can make use of any known methods described in literatures. For example, surface graft polymerization methods such as light graft polymerization method and plasma irradiation graft polymerization method are described on page 135 in "Shin-Kobunshi Jikkengaku 10" (New Polymer Experiment 10) edited by The Society of Polymer Science, Japan and published in 1994 by Kyoritsu Shuppan Co., Ltd. Further, a method of graft polymerization with radiation such as γ-rays and electron rays is described on pages 203 and 695 in "Kyuchaku Gijutsu Binran" (Adsorption Technology Handbook) edited by Takeuchi and published in February 1999 by NTS Co., Ltd.

As the light graft polymerization method, a method described in JP-A Nos. 63-92658, 10-296895 and 11-119413 can be used.

Alternatively, the surface having surface graft polymers can also be formed by adding reactive functional groups such as trialkoxy silyl group, isocyanate group, amino group, hydroxyl group and carboxyl group to the terminal of a polymeric compound chain and then subjecting these functional groups to coupling reaction with functional groups on the surface of the substrate.

In the plasma irradiation graft polymerization method and radiation irradiation graft polymerization method, graft polymerization can be carried out by methods described in the literatures supra and Y. Ikeda et al.: Macromolecules, vol. 19, page 1804 (1986). Specifically, the surface of a polymer such as PET is treated with plasma or electron rays, to generate radicals on the surface and then allowing the activated surface to react with monomers having hydrophilic functional groups, whereby a graft polymer surface layer, that is, a surface layer having hydrophilic groups can be obtained.

Alternatively, light graft polymerization can also be carried out by coating the surface of a film substrate with a photopolymerizable composition, then bringing the substrate into contact with an aqueous radical polymerizable compound and irradiating it with light, as shown in the literatures supra, JP-A No. 53-17407 (of Kansai Paint) and JP-A No. 2000-212313 (of Dainippon Ink).

Description of the Hydrophilic Monomers

The hydrophilic monomers useful for forming hydrophilic graft polymer chains include not only positively charged monomers such as ammonium and phosphonium, negatively charged groups such as sulfonate group, carboxyl group, phosphate group and phosphonate group or monomers having acid groups which can be dissociated to form negatively charged groups, but also hydrophilic monomers having nonionic groups such as hydroxyl group, amide group, sulfonamide group, alkoxy group and cyano group. In the invention, examples of particularly useful hydrophilic monomers include the following monomers. For example, (a carboxyl group, sulfonate group, phosphoric acid, amino group or salts of theseof) (meth)acrylic acid or an alkali metal salt and amine salt thereof, itaconic acid or an alkali metal salt and amine salt thereof, allyl amine or a hydrohalogenate thereof, 3-vinyl propionic acid or an alkali metal salt and amine salt thereof, vinylsulfonic acid or an alkali metal salt and amine salt thereof, vinylstyrene sulfonic acid or analkalimetal saltandaminesalt thereof, 2-sulfoethylene (meth)acrylate, 3-sulfopropylene (meth)acrylate or an alkali metal salt and amine salt thereof, 2-acrylamide-2-methyl propane sulfonic acid or an alkali metal salt and amine salt thereof, acid phosphoxy polyoxyethylene glycol mono (meth)acrylate, allyl amine or a hydrohalogenate thereof, (a carboxyl group, sulfonate group, phosphoric acid, amino group or salts of theseof) 2-trimethyl aminoethyl (meth) acrylate or a hydrohalogenate thereof can be used. Further, 2-hydroxyethyl (meth)acrylate, (meth)acrylamide, N-monomethylol (meth)acrylamide, N-dimethylol (meth) acrylamide, N-vinyl pyrrolidone, N-vinyl acetamide, allyl amine or a hydrohalogenate thereof, and polyoxyethyleneglycol mono(meth)acrylate are also useful.

[Method of Forming the Crosslinked Hydrophilic Layer Into Which Hydrophilic Graft Chains Were Introduced]

In the invention, the crosslinked hydrophilic layer into which hydrophilic graft chains were introduced can be formed generally by forming graft polymers by a known method of synthesizing graft polymers and then crosslinking the graft polymers. Specifically, synthesis of graft polymers is described in "Graft Jyugo To Sono Oyo" (Graft Polymerization and Its Application), written by Fumio Ide and published in 1977 by Kobunshi Publishing Company and "Shin-Kobunshi Jikkengaku 2, Kobunshi No Gosei Hanno" (New Polymer Experiment 2, Synthesis and Reaction of Polymer) edited by The Society of Polymer Science, Japan and published in 1995 by Kyoritsu Shuppan Co., Ltd.

Synthesis of graft polymers is divided basically into three methods of 1. polymerization of a branched monomer on a trunk polymer, 2. binding a branched polymer to a trunk polymer, and 3. copolymerization of a branched polymer with a trunk polymer (macromer method).

Any of the 3 methods described above can be used to form the hydrophilic surface in the invention, but particularly from the viewpoint of production suitability and regulation of film structure, "3. macromer method" is preferable.

Synthesis of graft polymers by using macromers is described in the above-mentioned literature "Shin-Kobunshi Jikkengaku 2, Kobunshi No Gosei Hanno" (Synthesis and Reaction of Polymer) edited by The Society of Polymer Science, Japan and published in 1995 by Kyoritsu Shuppan Co., Ltd. The synthesis is also described in detail in "Macromonomer No Kagaku To Kogyo" (Chemistry and Industry of Macromonomer) written by Takeshi Yamashita et al. and published in 1989 by IPC. Specifically, hydrophilic monomers exemplified as the organic crosslinked hydrophilic layer, such as acrylic acid, acrylamide, 2-acrylamide-2-methyl propane sulfonic acid and N-vinyl acetamide, can be used to synthesize hydrophilic macromers by a method described in the literature.

Particularly useful among the hydrophilic macromers used in the invention are macromers derived from carboxyl group-containing monomers such as acrylic acid and methacrylic acid, sulfonic acid type macromers derived from 2-acrylamide-2-methyl propane sulfonic acid, vinyl styrene sulfonic acid and monomer salts thereof, amide type macromers such as acrylamide and methacrylamide, amide type macromers derived from N-vinylcarboxylic acid amide monomers such as N-vinyl acetamide and N-vinyl formamide, macromers derived from hydroxy group-containing monomers such as hydroxyethyl methacrylate, hydroxyethyl acrylate and glycerol monomethacrylate, and macromers derived from alkoxy group- or ethylene oxide group-containing monomers such as methoxyethyl acrylate, methoxypolyethylene glycol acrylate and polyethylene glycol acrylate. Further, monomers having a polyethylene glycol chain or polypropylene glycol chain can also used usefully as the macromers in the invention.

The useful molecular weight of these macromers is in the range of 400 to 100,000, preferably in the range of 1,000 to 50,000 and particularly preferably in the range of 1,500 to 20,000. When the molecular weight is 400 or less, the effect is sufficiently demonstrated, while when the molecular weight is 100,000 or more, the polymerizability thereof with copolymerizable monomers forming main chains is deteriorated.

An alternative method of forming the crosslinked hydrophilic layer into which hydrophilic graft chains were introduced after synthesis of these hydrophilic macromers involves copolymerizing the hydrophilic macromers with other monomers having reactive functional groups to synthesize graft copolymers, then applying the graft copolymers and a crosslinking agent reacting with the reactive functional groups of the polymer onto a substrate and thermally reacting them to form crosslinkages therebetween. Alternatively, hydrophilic macromers and graft polymers having photocrosslinkable groups or polymerizable groups are synthesized, then applied onto a substrate and reacted by light irradiation to form crosslinkages therebetween.

In this manner, the substrate can be provided thereon with the hydrophilic surface on which hydrophilic graft polymer chains are present. The film thickness of the layer forming a hydrophilic surface can be selected depending on the object, but is generally in the range of 0.001 $\mu$m to 10 $\mu$m, more preferably in the range of 0.01 $\mu$m to 5 $\mu$m and most preferably in the range of 0.1 to 2 $\mu$m. If the film is too thin, mar resistance tends to be lowered, while if it is too thick, the ability to remove ink tends to be lowered.

Plate-making and Printing

Images are thermally formed on the planographic printing plate precursor of the invention. Specifically, direct image recording by a thermal recording head etc., scanning light exposure by an infrared laser, high-intensity flash exposure by a xenon luminescent lamp and light exposure by an infrared lamp can be used, and light exposure by a solid high-output infrared laser such as semiconductor laser and YAG laser which emit infrared rays in wavelengths of 700 to 1200 nm is preferable.

The planographic printing plate precursor of the invention which has been subjected to light exposure for images is fitted with a printer without special development, to enable printing in a usual manner with ink and moistening water. That is, after exposure to light, the non-exposed part of the planographic printing plate precursor is easily removed by aqueous components contained in moistening water etc. at an initial stage of printing, to form the non-image part.

The planographic printing plate precursor may be fitted with a cylinder in a printer, exposed to light by a laser mounted on the printer, supplied with moistening water and/or ink and developed in the machine, as described in Japanese Patent No. 2938398.

Further, the planographic printing plate precursor may also be developed with water or a suitable aqueous solution as the developing solution and then used in printing.

EXAMPLES

Hereinafter, the present invention is described in more detail by reference to the Examples, which however are not intended to limit the invention.

Examples 1 to 7 and Comparative Examples 1 and 2

Preparation of a Substrate

A melt of aluminum alloy containing 99.5% or more of aluminum, 0.30% of Fe, 0.10% of Si, 0.02% of Ti, and 0.013% of Cu was subjected to cleaning treatment and then cast. In this cleaning treatment, the melt was degassed to remove unnecessary gas such as hydrogen, and filtered through a ceramic tube filter. Casting was conducted using a DC casting method. After 10 mm in thickness of a surface layer was removed from a surface of the coagulated ingot plate of 500 mm in thickness, the plate was subjected to homogenization treatment at 550° C. for 10 hours such that intermetallic compounds were not agglomerated. Then, the plate was hot-rolled at 400° C., then annealed at 500° C. for 60 seconds in a continuous annealing furnace and cold-rolled to form an aluminum rolled plate of 0.30 mm in thickness. By regulating the roughness of pressure rollers, the central line average surface roughness Ra after cold rolling was regulated to be 0.2 $\mu$m. Thereafter, the plate was placed in a tension leveler to improve flatness.

Then, the plate was subjected to surface treatment to form a substrate for planographic printing plate.

First, the surface of the aluminum plate was defatted at 50° C. for 30 seconds in 10% aqueous sodium aluminate to remove the rolling oil therefrom and then neutralized with 30% aqueous sulfuric acid at 50° C. for 30 seconds, to remove smuts therefrom.

Then, the surface of the substrate was roughened (i.e. grained) thereby facilitating the adhesion of the photosensitive layer to the substrate while conferring water retention characteristics on the non-image part. The substrate was subjected to electrolytic graining by floating the aluminum web in an aqueous solution containing 1% of nitric acid and 0.5% of aluminum nitrate at 45° C. and electrifying it at 240 C/dm$^2$ at the side of the anode at a current density of 20 A/dm$^2$ in an alternating waveform in the duty ratio of 1:1 from an indirect feeder cell. Thereafter, the substrate was etched at 50° C. for 30 seconds in 10% of aqueous sodium aluminate and then neutralized with 30% of aqueous sulfuric acid at 50° C. for 30 seconds to remove smuts therefrom.

Further, the substrate was anodized to form an oxide film thereon, to improve abrasion resistance, chemical resistance and water retention characteristics. The substrate was subjected to electrolysis in 20% of aqueous sulfuric acid as the electrolyte at 35° C. at a direct current of 14 A/dm$^2$ from an indirect feeder cell while floating the aluminum web in the electrolyte, to form a 2.5 g/m$^2$ of anodized film thereon.

Thereafter, the surface of the substrate was rendered hydrophilic by treating it with a silicate, in order to secure hydrophilicity on the non-image part in the planographic printing plate precursor. This treatment was conducted by passing 1.5% of aqueous sodium silicate solution at 70° C. such that the contact time thereof with the aluminum web was 15 seconds, and then the substrate was washed with water. The amount of Si adhering thereto was 10 mg/m$^2$. The Ra (central line surface roughness) of the substrate thus prepared was 0.25 $\mu$m.

Synthesis 1 of Particulate Polymer

Synthesis of Particulate Polymer (1)

5.88 g of 25 weight-% aqueous solution of surfactant (trade name: NIKKOL SBL-4N, manufactured by Nikko Chemicals Co., Ltd.) and 660 mL distilled water were placed in a 1-L three-necked flask and stirred for 10 minutes at 75° C. in a nitrogen stream. 0.231 g of potassium persulfate, 1.75 mL of 1 N aqueous sodium bicarbonate, and 10 mL of distilled water were added thereto, and then a mixed solution of 49.77 g of t-butyl methacrylate and 32.13 g of ethylene glycol methacrylate acetoacetate was added thereto dropwise over 3 hours. After this addition was finished, a solution prepared by mixing 0.231 g of potassium persulfate, 1.75 mL of 1 N aqueous sodium bicarbonate, and 10 mL of distilled water was added thereto, and the mixture was stirred for 3 hours. The resultant reaction mixture was cooled to room temperature and filtered through a glass filter, to give particulate polymer (1). The solids content of the aqueous solution of the particulate polymer (1) thus obtained was 11% by weight, and the average particle diameter was 0.090 $\mu$m.

Synthesis of Particulate Polymer (2)

2.14 g of dodecyl trimethyl ammonium bromide and 540 mL of distilled water were placed in a 1-L three-necked flask and stirred for 10 minutes at 65° C. in a nitrogen stream. A solution of 0.543 g of 2,2'-azobis(2-amidinopropane) dihydrochloride in 10 mL of distilled water was added, and then a mixed solution of 56 g of methyl methacrylate and 14 g of ammonium monomer (i) was added thereto dropwise over 3 hours. After this addition was finished, a solution of 0.543 g of 2,2'-azobis(2-amidinopropane) dihydrochloride in 10 mL of distilled water was further added thereto, and the mixture was stirred for 3 hours. The resultant reaction mixture was cooled to room temperature and filtered through a glass filter, to give particulate polymer (2). The solids content of the aqueous solution of the particulate polymer (2) thus obtained was 9.5% by weight, and the average particle diameter was 0.105 $\mu$m.

(i)

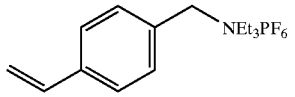

Synthesis of Particulate Polymer (3)

50.06 g of methyl methacrylate, 2.51 g of phosphate ester monomer (trade name: Phosmer PE8, manufactured by Uni-Chemical Co., Ltd.) and 400 mL of distilled water were placed in a 1-L three-necked flask and stirred for 10 minutes at 75° C. in a nitrogen stream. A mixed solution of 0.231 g of potassium persulfate, 1.75 mL of 1 N aqueous sodium bicarbonate and 10 mL of distilled water was added thereto, and the mixture was stirred for 3 hours. Three hours later, a solution prepared by mixing 0.231 g of potassium persulfate, 1.75 mL of 1 N aqueous sodium bicarbonate and 10 mL of distilled water was added thereto, and the mixture was stirred for 3 hours. The resultant reaction mixture was cooled to room temperature and filtered through a glass filter, to give particulate polymer (3). The solids content of the aqueous solution of the particulate polymer (3) thus obtained was 10.8% by weight, and the average particle diameter was 0.220 $\mu$m.

Synthesis of Particulate Polymer (4)

1.00 g of surfactant (trade name: Hostapal 122, manufactured by Clariant) and 400 mL of distilled water were placed in a 1-L three-necked flask and stirred for 10 minutes at 75° C. in a nitrogen stream. A mixed solution of 0.231 g of potassium persulfate, 1.75 mL of 1 N aqueous sodium bicarbonate and 10 mL of distilled water was added thereto, and 50.06 g of methyl methacrylate was added thereto dropwise for 3 hours. After this addition was finished, a solution prepared by mixing 0.231 g of potassium persulfate, 1.75 mL of 1 N aqueous sodium bicarbonate and 10 mL of distilled water was added thereto, and the mixture was stirred for 3 hours. The resultant reaction mixture was cooled to room temperature and filtered through a glass filter, to give particulate polymer (4). The solids content of the aqueous solution of the particulate polymer (4) thus obtained was 10.5% by weight, and the average particle diameter was 0.080 μm.

Synthesis of Particulate Polymer (5)

40 g of reaction product of trimethylolpropane and xylenediisocyanate with molar ratio of 1:3 (trade name: D-110N, manufactured by Takeda Chemical Industries, Ltd.), 8 g poly(ethyl methacrylate), 2 g mononaphthalene phosphate (ii), 3 g IR-33 and 0.1 g of 70% methanol solution of calcium dodecylbenzenesulfonate (trade name: Pionine A-41-C, manufactured by Takemoto Oil & Fat Co., Ltd.) were dissolved as oil-phase components in 60 g of ethyl acetate. As the aqueous-phase component, 120 g of 4% aqueous polyvinyl alcohol (trade name: PVA205, manufactured by Kuraray Co., Ltd.) was prepared. The oil-phase components and the aqueous-phase component were emulsified at 10000 rpm with a homogenizer. Thereafter, 40 g of water was added thereto, and the mixture was stirred at room temperature for 30 minutes, then at 40° C. for 3 hours and at 60° C. for 2 hours. The average particle diameter of the microcapsules thus obtained was 0.4 μm, and the solids content thereof was 18% by weight.

(ii)

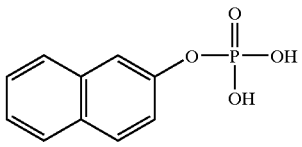

Synthesis of Particulate Polymer (6)

6.82 g of 25 weight-% aqueous solution of surfactant (trade name: NIKKOL SBL-4N, manufactured by Nikko Chemicals Co., Ltd.) and 660 mL of distilled water were placed in a 1-L three-necked flask and stirred for 10 minutes at 75° C. in a nitrogen stream. A mixed solution of 0.231 g potassium persulfate, 1.75 mL of 1 N aqueous sodium bicarbonate and 10 mL distilled water was added thereto, and a mixed solution of 71.10 g of t-butyl methacrylate and 14.22 g of ethylene glycol diacetoacetate was added thereto dropwise over 3 hours. After this addition was finished, a mixed solution of 0.231 g potassium persulfate, 1.75 mL of 1 N aqueous sodium bicarbonate and 10 mL of distilled water was further added thereto, and the mixture was stirred for 3 hours. The resultant reaction mixture was cooled to room temperature and filtered through a glass filter, to give particulate polymer (6). The solids content of the aqueous solution of the particulate polymer (6) thus obtained was 11.3% by weight, and the average particle diameter was 0.075 μm.

Synthesis of Particulate Polymer (7)

5.0 g of methyl methacrylate/methacrylamide copolymer (molar ratio of 80/20), 1.0 g of pyridine-N-oxide (iii), and 1.5 g of light-heat converting agent (I-33) were dissolved in 18.0 g of ethyl acetate/MEK (4/1) as the solvent, then mixed with 36 g of 4% aqueous polyvinyl alcohol (trade name: PVA205, manufactured by Kuraray Co., Ltd.) and emulsified at 10000 rpm for 10 minutes with a homogenizer. Thereafter, the mixture was stirred at 60° C. for 90 minutes, during which the ethyl acetate and MEK were evaporated, whereby particulate polymer (7) having an average particle diameter of 0.28 μm was obtained. The solids content of this aqueous solution was 12.8%.

(iii)

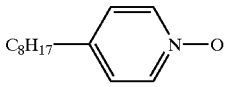

Synthesis of Particulate Polymer (8) not Having Interacting Functional Groups (Comparative Example Polymer)

12.31 g of 25 weight-% aqueous solution of surfactant (trade name: NIKKOL SBL-4N, manufactured by Nikko Chemicals Co., Ltd.) and 810 mL of distilled water were placed in a 2-L three-necked flask and stirred for 10 minutes at 75° C. in a nitrogen stream. A mixed solution of 0.462 g potassium persulfate, 3.5 mL of 1 N aqueous sodium bicarbonate and 14 mL of distilled water was added thereto, and then 104.15 g of styrene was added thereto dropwise over 3 hours. After this addition was finished, a mixed solution of 0.462 g of potassium persulfate, 3.5 mL of 1 N aqueous sodium bicarbonate and 14 mL of distilled water was further added thereto, and the mixture was stirred for 3 hours. The resultant reaction mixture was cooled to room temperature and filtered through a glass filter, to give particulate polymer (8). The solids content of the aqueous solution of the particulate polymer (8) thus obtained was 11.5% by weight, and the average particle diameter was 0.080 μm.

Synthesis of Particulate Polymer (9) not Having Interacting Functional Groups (Comparative Example Polymer)

6.0 g of poly(methyl methacrylate) and 1.5 g of light-heat converting agent (I-33) were dissolved in 18.0 g of ethyl acetate/MEK (4/1) as the solvent, then mixed with 36 g of 4% aqueous polyvinyl alcohol (trade name: PVA205, manufactured by Kuraray Co., Ltd.) and emulsified at 10000 rpm for 10 minutes with a homogenizer. Thereafter, the mixture was stirred at 60° C. for 90 minutes, during which the ethyl acetate and MEK were evaporated, whereby particulate polymer (9) having an average particle diameter of 0.28 μm was obtained. The solids content of this aqueous solution was 12.1%.

Preparation of a Planographic Printing Plate Precursor

The aluminum substrate described above was coated by a rod bar with a heat-sensitive layer (1) coating solution prepared in the manner described below, and then dried at 60° C. for 3 minutes to give a planographic printing plate precursor.

Heat-sensitive Layer (1) Coating Solution

| | |
|---|---|
| Aqueous solution of the particulate polymer (fine particles shown in Table 1: in terms of solids content) | 0.80 g |
| Polyacrylic acid (weight-average molecular weight: 25,000) | 0.14 g |
| Light-heat converting agent (I-32) | 0.05 g |
| Distilled water (added at a solids content of 7% by weight) | |

The particulate polymer number used in the resultant planographic printing plate precursor and the coating thereof after drying are shown in Table 1.

TABLE 1

| | Substrate | Heat-sensitive layer | | Coating after drying ($g/m^2$) |
|---|---|---|---|---|
| Planographic printing plate precursor (1) | Hydrophilic Al plate | Heat-sensitive layer (1) | Fine particle (1) | 0.70 |
| Planographic printing plate precursor (2) | Hydrophilic Al plate | Heat-sensitive layer (1) | Fine particle (2) | 0.75 |
| Planographic printing plate precursor (3) | Hydrophilic Al plate | Heat-sensitive layer (1) | Fine particle (3) | 0.65 |
| Planographic printing plate precursor (4) | Hydrophilic Al plate | Heat-sensitive layer (1) | Fine particle (4) | 0.80 |
| Planographic printing plate precursor (5) | Hydrophilic Al plate | Heat-sensitive layer (1) | Fine particle (5) | 1.00 |
| Planographic printing plate precursor (6) | Hydrophilic Al plate | Heat-sensitive layer (1) | Fine particle (6) | 0.90 |
| Planographic printing plate precursor (7) | Hydrophilic Al plate | Heat-sensitive layer (1) | Fine particle (7) | 0.85 |
| Planographic printing plate precursor (8) | Hydrophilic Al plate | Heat-sensitive layer (1) | Fine particle (8) (Comparative Polymer) | 0.70 |
| Planographic printing plate precursor (9) | Hydrophilic Al plate | Heat-sensitive layer (1) | Fine particle (9) (Comparative Polymer) | 0.75 |

The resultant planographic printing plate precursors (1) to (9) were exposed to light under the conditions of a power of 9 W, an external drum revolution of 210 rpm, an energy of 100 $mJ/cm^2$ on the plate and a resolution of 2400 dpi by Trendsetter-3244VFS (trade name, manufactured by Creo) equipped with a water-cooling 40-W infrared semiconductor laser, then attached without development to a cylinder in a printer (trade name: SOR-M, manufactured by Heidelberg), supplemented with moistening water and ink and further with paper for printing. All the plates could be developed in the machine to enable printing. The number of print plates required for development in the machine and the number of the resultant prints are shown in Table 2.

TABLE 2

| | Planographic printing plate precursor | Number of print plates in the machine | Printing resistance |
|---|---|---|---|
| Example 1 | Planographic printing plate precursor (1) | 20 | 60,000 |
| Example 2 | Planographic printing plate precursor (2) | 25 | 55,000 |
| Example 3 | Planographic printing plate precursor (3) | 25 | 45,000 |
| Example 4 | Planographic printing plate precursor (4) | 50 | 40,000 |
| Example 5 | Planographic printing plate precursor (5) | 30 | 30,000 |
| Example 6 | Planographic printing plate precursor (6) | 30 | 45,000 |
| Example 7 | Planographic printing plate precursor (7) | 30 | 35,000 |
| Comparative Example 1 | Planographic printing plate precursor (8) | 30 | 20,000 |
| Comparative Example 2 | Planographic printing plate precursor (9) | 150 | 15,000 |

The planographic printing plate precursors (1) to (7) in the invention were excellent in development performance in the machine to give 30,000 or more good prints. On the other hand, the planographic printing plate precursors (8) and (9) in the comparative examples using particulate polymers not having functional groups interacting with the hydrophilic surface of the substrate gave only about 20,000 good prints. As a result, it was evident that printing resistance could be improved by providing the substrate with a heat-sensitive layer containing particulate polymers having functional groups interacting with the hydrophilic surface thereof.

Examples 8 to 14 and Comparative Example 3

Synthesis 2 of Particulate Polymer

Synthesis of Particulate Polymer (10) Having Interacting Groups 5.5 g of N-vinyl pyridine, 7.5 g of butyl methacrylate, and 200 ml of aqueous solution of polyoxyethylene nonyl phenol (concentration of $9.84\times10^{-3}$ mol/L) were added and stirred at 250 rpm while the atmosphere in the system was replaced by a nitrogen gas. After the temperature of this solution was made 25° C., 10 ml of aqueous solution of cerium (IV) ammonium salt (concentration of $0.984\times10^{-3}$ mol/L) was added thereto, during which the solution was adjusted to pH 1.3 to 1.4 with an aqueous solution of ammonium nitrate (concentration of $58.8\times10^{-3}$ mol/L). Thereafter, the mixture was stirred for 8 hours. The solids content of the solution thus obtained was 9.5%, and the average particle diameter was 0.3 $\mu$m.

Synthesis of Particulate Polymer (11) Having Interacting Groups 9.0 g of N-triethyl ammonium methyl styrene tolylate, 6.5 g of butyl methacrylate, and 200 ml of aqueous solution of polyoxyethylene nonyl phenol (concentration of $9.84\times10^{-3}$ mol/L) were added and stirred at 250 rpm while the atmosphere in the system was replaced by a nitrogen gas. After the temperature of this solution was made 25° C., 10 ml of aqueous solution of cerium (IV) ammonium salt (concentration of $0.984\times10^{-3}$ mol/L) was added thereto, during which the solution was adjusted to pH 1.3 to 1.4 with an aqueous solution of ammonium nitrate (concentration of $58.8\times10^{-3}$ mol/L). Thereafter, the mixture was stirred for 8 hours. The solids content of the solution thus obtained was 9.0%, and the average particle diameter was 0.1 $\mu$m.

Synthesis of Particulate Polymer (12) Having Interacting Groups 3.12 g of dodecyl trimethyl ammonium bromide and 450 mL of distilled water were placed in a 1-L three-necked flask and stirred for 10 minutes at 65° C. in a nitrogen stream. A solution of 0.678 g of 2,2'-azobis(2-amidinopropane) dihydrochloride in 10 mL of distilled water was added thereto, and then 52.08 g of styrene was added thereto dropwise over 3 hours. After this addition was finished, a solution of 0.678 g of 2,2'-azobis(2-amidinopropane) dihydrochloride in 10 mL of distilled water was further added thereto, and the mixture was stirred for 3 hours. The resultant reaction mixture was cooled to room temperature and filtered through a glass filter, to give particulate polymer (12). The solids content of the aqueous solution of the particulate polymer (12) thus obtained was 9.5% by weight, and the average particle diameter was 0.105 $\mu$m.

Synthesis of Particulate Polymer (13) Having Interacting Groups 6.82 g of 25 weight-% aqueous solution of surfactant (trade name: NIKKOL SBL-4N, manufactured by Nikko Chemicals Co., Ltd.) and 660 mL of distilled water were placed in a 1-L three-necked flask and stirred for 10 minutes at 75° C. in a nitrogen stream. A mixed solution of 0.231 g of potassium persulfate, 1.75 mL of 1 N aqueous sodium bicarbonate and 10 mL of distilled water was added thereto, and a mixed solution of 71.10 g of t-butyl methacrylate and 14.22 g of 4-dodecyl pyridine was added thereto dropwise over 3 hours. After this addition was finished, a mixed solution of 0.231 g of potassium persulfate, 1.75 mL of 1 N aqueous sodium bicarbonate and 10 mL of distilled water was further added thereto, and the mixture was stirred for 3 hours. The resultant reaction mixture was cooled to room temperature and filtered through a glass filter, to give particulate polymer (13). The solids content of the aqueous solution of the particulate polymer (13) thus obtained was 11.3% by weight, and the average particle diameter was 0.075 μm.

Synthesis of Particulate Polymer (14) not Having Interacting Groups (Comparative Example Polymer)

The particulate polymer (14) was polymerized in the same manner as in Synthesis Example (10) except that 15 g of butyl methacrylate was used in place of N-vinyl pyridine and butyl methacrylate in synthesis of the particulate polymer (10). The solids content of the dispersion of the particulate polybutyl methacrylate homo-copolymer thus obtained was 9.5% by weight, and the average particle diameter was 0.2 μm.

Preparation of Microcapsule (1)

40 g of xylene diisocyanate, 10 g of N-vinyl pyridine-butyl methacrylate copolymer (molar ratio of 7/3) and 0.1 g of 70% methanol solution of calcium dodecylbenzenesulfonate (trade name: Pionine A-41-C, manufactured by Takemoto Oil & Fat Co., Ltd.) were dissolved as oil-phase components in 60 g of ethyl acetate. As the aqueous-phase component, 120 g of 4% aqueous polyvinyl alcohol (trade name: PVA205, manufactured by Kuraray Co., Ltd.) was prepared. The oil-phase components and the aqueous-phase component were emulsified at 10000 rpm with a homogenizer. Thereafter, 40 g of water was added thereto, and the mixture was stirred at room temperature for 30 minutes and at 40° C. for 3 hours. The solids content of the microcapsule dispersion thus obtained was 20%, and the average particle diameter was 0.7 μm.

Preparation of a Hydrophilic Surface

A PET film of 0.188 mm in thickness (trade name: M4100, manufactured by Toyobo Co., Ltd.) was coated by rod bar No. 17 with the photopolymerizable composition described below and dried at 80° C. for 2 minutes. Then, the coated film was irradiated for 10 minutes with a 400-W high-pressure mercury lamp (trade name: UVL-400P, manufactured by Riko Kagaku Sangyo Co., Ltd.). Then, this film was dipped in an aqueous monomer solution and irradiated with light for 30 minutes by a 400-W high-pressure mercury lamp in an argon atmosphere. The film obtained after light irradiation was washed well with deionized water.

The photopolymerizable composition has the following composition:

| | |
|---|---|
| Allyl methacrylate/methacrylic acid copolymer (molar ratio 80/20, molecular weight 100,000) | 4 g |
| Ethylene oxide-modified bisphenol A diacrylate (trade name: M210, manufactured by Toagosei Co., Ltd.) | 4 g |
| 1-Hydroxycyclohexyl phenyl ketone | 1.6 g |
| 1-Methoxy-2-propanol | 16 g |

Preparation of a Substrate Having a Surface Made of Hydrophilic Graft Polymers

A biaxially stretched polyethylene terephthalate film of 188 μm in thickness (trade name: A4100, manufactured by Toyobo Co., Ltd.) was subjected to oxygen glow treatment under the following conditions by a planographic magnetron sputtering unit as glow treatment (trade name: CFS-10-EP70, manufactured by Shibaura Eletec Corporation).

(Conditions for Oxygen Glow Treatment)

Initial vacuum: $1.2\times10^{-3}$ Pa,

Oxygen pressure: 0.9 Pa,

RF glow: 1.5 KW,

Treatment time: 60 seconds.

Then, the film thus subjected to glow treatment was dipped at 70° C. for 7 hours in an aqueous solution of Na styrene sulfonate (10 wt-%) previously bubbled with nitrogen. The dipped filmwas washed with water for 8 hours, whereby a substrate (hydrophilic surface 1) having Na styrene sulfonate graft-polymerized on the surface thereof was obtained.

Separately, a film (hydrophilic surface 2) having acrylic acid graft-polymerized on the surface thereof was obtained in the same manner as above except that acrylic acid was used in place of Na styrene sulfonate.

The hydrophilic surface 1 or 2 was coated with the heat-sensitive layer (2) or (3) coating solution below to form a heat-sensitive layer thereon. After coating, the heat-sensitive layer was dried (at 100° C. for 60 seconds in an oven) to give a 0.5 g/m$^2$ dry coating.

Heat-sensitive Layer (2) Coating Solution

| | |
|---|---|
| Synthesized particulate polymers (fine particles shown in Table 3) | 5 g in terms of solids content |
| Polyhydroxyethyl acrylate (weight-average molecular weight 25,000) | 0.5 g |
| IR absorbing dye (IR-11) | 0.3 g |
| Water | 100 g |
| (Heat-sensitive layer (3) coating solution) | |
| Synthesized microcapsules (1) | 5 g in terms of solids content |
| Polyhydroxyethyl acrylate (weight-average molecular weight 25,000) | 2.5 g |
| IR absorbing dye (IR-11: structure is shown below) | 0.3 g |
| Water | 60 g |
| 1-Methoxy-2-propanol | 40 g |

IR-11

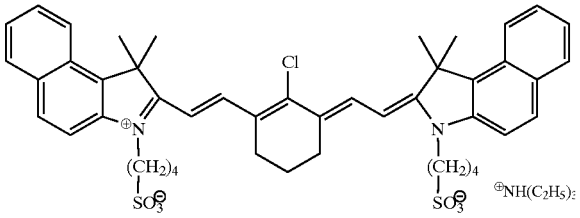

By combining the hydrophilic surface of the substrate with the coated heat-sensitive layer as shown in Table 3 shown later, the planographic printing plate precursors in Examples 8 to 14 and Comparative Example 3 were prepared.

Plate-making and Evaluation of the Planographic Printing Plate Precursors

The planographic printing plate thus obtained in Examples 8 to 14 and Comparative Example 3, which could be developed in a machine, were exposed to light from Trendsetter-3244VFS (trade name, manufactured by Creo) equipped with a water-cooling 40-W infrared semiconductor laser, and then attached without development to a cylinder inaprinter (tradename: SOR-M, manufactured by Heidelberg), supplemented with moistening water and ink and further with paper for printing.

The light exposure necessary for forming an image in each planographic printing plate was measured and expressed as recording sensitivity. How many good prints could be obtained by printing with this light exposure was determined as the criterion of printing resistance. The results are shown in Table 3 below.

TABLE 3

| | Substrate | Heat-sensitive layer | | Sensitivity (mj/cm$^2$) | Printing resistance |
|---|---|---|---|---|---|
| Example 8 | Hydrophilic surface 1 | Heat-sensitive layer (2) | Fine particle (10) | 330 | 30,000 |
| Example 9 | Hydrophilic surface 1 | Heat-sensitive layer (2) | Fine particle (11) | 350 | 25,000 |
| Example 10 | Hydrophilic surface 1 | Heat-sensitive layer (3) | Microcapsule (1) | 350 | 28,000 |
| Example 11 | Hydrophilic surface 2 | Heat-sensitive layer (2) | Fine particle (10) | 280 | 20,000 |
| Example 12 | Hydrophilic surface 2 | Heat-sensitive layer (3) | Microcapsule (1) | 250 | 25,000 |
| Example 13 | Hydrophilic surface 1 | Heat-sensitive layer (2) | Fine particle (12) | 350 | 25,000 |
| Example 14 | Hydrophilic surface 2 | Heat-sensitive layer (2) | Fine particle (13) | 350 | 20,000 |
| Comparative Example 3 | Hydrophilic surface 1 | Heat-sensitive layer (2) | Fine particle (14) (Comparative Polymer) | 350 | 5,000 |

From the above results, it was found that the planographic printing plate precursors of the invention enable highly sensitive recording and are excellent in printing resistance. On the other hand, it was found that the planographic printing plate precursor in Comparative Example 4 using a conventional hydrophilic substrate of aluminum is inferior in both sensitivity and printing resistance to the planographic printing plate precursors of the invention using a hydrophilic surface having hydrophilic graft polymers, and the planographic printing plate precursor in Comparative Example 3 using the thermoplastic particulate polymer (14) (Comparative Polymer) which has a similar particle diameter but does not have functional groups interacting with the graft polymers is inferior in printing resistance to the planographic printing plate precursors in the Examples.

According to the invention, there is obtained a planographic printing plate precursor developable in a machine i.e. usable in printing directly after light exposure by fitting it with a printer, which can be used directly in printing from digital data by recording with a solid laser or semiconductor laser emitting infrared rays, is excellent in development performance in the machine, and has high sensitivity and high printing resistance.

What is claimed is:

1. A planographic printing plate precursor which comprises an aluminum substrate, which is subjected to treatment with alkali metal silicate, potassium fluorozirconate or polyvinyl phosphonic acid to form the hydrophilic surface, and having disposed thereon a heat-sensitive layer comprising at least one selected from the group consisting of (a) a thermoplastic particulate polymer having functional groups capable of interacting with the hydrophilic surface and (b) microcapsules containing a compound having functional groups capable of interacting with the hydrophilic surface.

2. The planographic printing plate precursor according to claim 1, wherein the heat-sensitive layer contains a thermoplastic particulate polymer having functional groups capable of interacting with the hydrophilic surface.

3. The planographic printing plate precursor according to claim 2, wherein the heat fusion temperature or the thermoplastic particulate polymer is 80 to 250° C.

4. The planographic printing plate precursor according to claim 2, wherein the average particle diameter of the thermoplastic particulate polymer is 0.01 to 20 $\mu$m.

5. The planographic printing plate precursor according to claim 2, wherein the heat-sensitive layer further comprises a hydrophilic resin and a light-heat converting agent.

6. The planographic printing plate precursor according to claim 1, wherein the heat-sensitive layer comprising microcapsules comprises a compound having functional groups capable of interacting with the hydrophilic surface.

7. The planographic printing plate precursor according to claim 6, wherein the average particle diameter of the microcapsules is 0.01 to 20 $\mu$m.

8. The planographic printing plate precursor according to claim 6, wherein the heat-sensitive layer further comprises a hydrophilic resin and a light-heat converting agent.

9. A method of printing with a planographic printing plate precursor having an image thermally formed thereon and comprising an aluminum substrate, which is subjected to treatment with alkali metal silicate, potassium fluorozirconate or polyvinyl phosphonic acid to form the hydrophilic surface, and having disposed thereon a heat-sensitive layer containing a thermoplastic particulate polymer having functional groups capable of interacting with the hydrophilic surface, the method comprising applying ink to the surface of the plate with the image thermally formed thereon and conducting printing.

10. A method of printing with a planographic printing plate precursor having an image thermally formed thereon and comprising an aluminum substrate, which is subjected to treatment with alkali metal silicate, potassium fluorozirconate or polyvinyl phosphonic acid to form the hydrophilic surface, and having disposed thereon a heat-sensitive layer containing a thermoplastic particulate polymer having functional groups capable of interacting with the hydrophilic surface, the method comprising applying ink to the surface of the plate with the image thermally formed thereon and conducting printing.

* * * * *

UNITED STATES PATENT AND TRADEMARK OFFICE

CERTIFICATE OF CORRECTION

PATENT NO. : 6,951,171 B2
DATED : October 4, 2005
INVENTOR(S) : Hidekazu Oohashi et al.

It is certified that error appears in the above-identified patent and that said Letters Patent is hereby corrected as shown below:

Title page,
Item [56], References Cited, FOREIGN PATENT DOCUMENTS, add:
-- EP 0 646 476 A1 04-05-1995
JP 2001-205952 A 07-31-2001
EP 1 216 831 A1 06-26-2002 --.

Signed and Sealed this

Twenty-first Day of March, 2006

JON W. DUDAS
*Director of the United States Patent and Trademark Office*